US008910514B2

(12) United States Patent
Sullivan et al.

(10) Patent No.: US 8,910,514 B2
(45) **Date of Patent: *Dec. 16, 2014**

(54) SYSTEMS AND METHODS OF DETERMINING FLUID PROPERTIES

(75) Inventors: Matthew T. Sullivan, Westwood, MA (US); Christopher Harrison, Auburndale, MA (US); Robert J. Schroeder, Cambridge, MA (US); Ahmad Latifzai, Houston, TX (US); Elizabeth Smythe, Cambridge, MA (US); Shunsuke Fukagawa, Cambridge, MA (US); Douglas W. Grant, Cedar Creek, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/403,989

(22) Filed: Feb. 24, 2012

(65) Prior Publication Data

US 2013/0219997 A1 Aug. 29, 2013

(51) Int. Cl.
*G01N 22/00* (2006.01)

(52) U.S. Cl.
USPC ..... 73/152.24; 73/152.08; 73/152.12; 73/152.13; 73/152.55

(58) Field of Classification Search
USPC ..... 73/152.01–152.62
See application file for complete search history.

(56) References Cited

U.S. PATENT DOCUMENTS 5,901,788 A * 5/1999 Brown et al. ..... 166/264
RE38,129 E * 6/2003 Kleinberg ..... 73/152.18
7,083,009 B2 * 8/2006 Paluch et al. ..... 175/59
7,114,562 B2 10/2006 Fisseler et al.
7,461,547 B2 12/2008 Terabayashi et al.
7,526,953 B2 * 5/2009 Goodwin et al. ..... 73/152.28
7,556,096 B2 * 7/2009 Vinegar et al. ..... 166/250.01
7,687,769 B2 3/2010 Indo et al.
7,687,770 B2 3/2010 Indo et al.
7,788,972 B2 9/2010 Terabayashi et al.
8,109,140 B2 * 2/2012 Tustin et al. ..... 73/152.24
8,131,468 B2 * 3/2012 Kischkat et al. ..... 702/6
8,136,394 B2 * 3/2012 Hsu et al. ..... 73/152.24
2002/0194906 A1 * 12/2002 Goodwin et al. ..... 73/152.46
2002/0194907 A1 * 12/2002 Bostrom et al. ..... 73/152.58
2003/0033866 A1 * 2/2003 Diakonov et al. ..... 73/152.55
2003/0164038 A1 * 9/2003 Han et al. ..... 73/152.58
2004/0050072 A1 * 3/2004 Palfy et al. ..... 62/3.4
2006/0250454 A1 * 11/2006 Silverbrook et al. ..... 347/62
2007/0214877 A1 * 9/2007 Shammai ..... 73/152.24
2009/0078036 A1 3/2009 Terabayashi et al.

(Continued)

FOREIGN PATENT DOCUMENTS

WO 2007/048991 5/2007
WO 2009/082674 7/2009
WO WO2009/082674 A1 * 7/2009 ..... G01N 27/02

*Primary Examiner* — Peter Macchiarolo
*Assistant Examiner* — Alexander Mercado
(74) *Attorney, Agent, or Firm* — Daryl R. Wright; Jody DeStefanis

(57) ABSTRACT

Systems and methods of determining fluid properties are disclosed. An example apparatus to determine a saturation pressure of a fluid includes a housing having a detection chamber and a heater assembly partially positioned within the detection chamber to heat a fluid. The example apparatus also includes a sensor assembly to detect a property of the fluid and a processor to identify a saturation pressure of the fluid using the property of the fluid.

23 Claims, 20 Drawing Sheets

(56) References Cited

U.S. PATENT DOCUMENTS

| | | | | |
|---|---|---|---|---|
| 2009/0314077 | A1* | 12/2009 | Tustin et al. | 73/152.24 |
| 2009/0321072 | A1 | 12/2009 | Kanayama et al. | |
| 2010/0006284 | A1* | 1/2010 | Sonne et al. | 166/264 |
| 2010/0050760 | A1 | 3/2010 | Vannuffelen et al. | |
| 2010/0147065 | A1 | 6/2010 | Tan et al. | |
| 2010/0265492 | A1* | 10/2010 | Schroeder et al. | 356/51 |
| 2010/0269579 | A1 | 10/2010 | Lawrence et al. | |
| 2011/0218736 | A1 | 9/2011 | Pelletier | |
| 2011/0259090 | A1 | 10/2011 | Angelescu et al. | |

* cited by examiner

SYSTEMS AND METHODS OF DETERMINING FLUID PROPERTIES

BACKGROUND

Fluid properties that are of interest when producing hydrocarbons include bubble point (BP) and dew point (DP). To determine these properties, fluid samples may be brought to the surface for analysis. However, bringing the samples to the surface may cause irreversible changes in the composition and/or phase behavior of the fluid (e.g., asphaltene and/or wax precipitation). These irreversible changes make subsequent measurements of saturation pressure less accurate.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

An example apparatus to determine a saturation pressure of a fluid includes a housing having a detection chamber and a heater assembly partially positioned within the detection chamber to heat a fluid. The example apparatus also includes a sensor assembly to detect a property of the fluid and a processor to identify a saturation pressure of the fluid using the property of the fluid.

An example method of determining a saturation pressure of a fluid includes thermally nucleating a fluid within a detection chamber, detecting a property of the fluid and determining a saturation pressure of the fluid using the property.

An example downhole tool includes a microfluidic device having a detection chamber, a heater assembly at least partially positioned within the detection chamber to heat a fluid and a sensor assembly to detect a property of the fluid. The downhole tool also includes a processor to determine a parameter of the downhole fluid using the property of the fluid.

FIGURES

Embodiments of systems and methods of determining parameter values in a downhole environment are described with reference to the following figures. The same numbers are used throughout the figures to reference like features and components.

DETAILED DESCRIPTION

Figure 1:
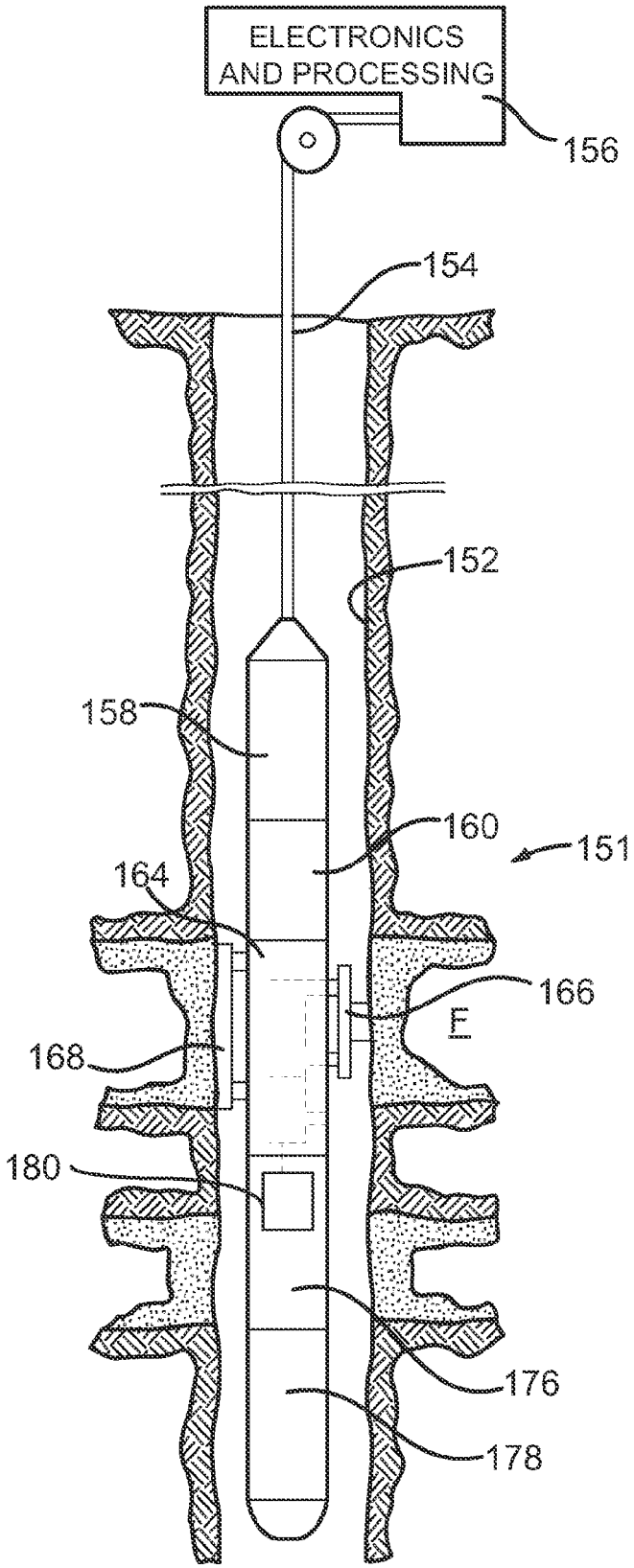
FIG. 1 illustrates an example system in which embodiments of the systems and methods of determining parameter values in a downhole environment can be implemented.

In the following detailed description of the embodiments, reference is made to the accompanying drawings, which form a part hereof, and within which are shown by way of illustration specific embodiments by which the examples described herein may be practiced. It is to be understood that other embodiments may be utilized and structural changes may be made without departing from the scope of the disclosure.

Production decisions for a new well (e.g., an oil well) may be based on measurements of the downhole fluid. These measurements may be conducted downhole and/or uphole (e.g., at a laboratory). The information obtained from the downhole fluid measurements may be used to decide which formation zones are economical to produce and/or for proper infrastructure planning. Some of the information obtained from the downhole fluid measurements may include information relating to the chemical composition, phase diagram, density and/or viscosity of the fluid.

Fluid properties that are of interest when producing hydrocarbons include bubble point (BP) and dew point (DP). The BP and DP may be referred to as saturation pressures. At high pressures and temperatures, such as those present downhole, a large amount of gas may be dissolved in the downhole fluid (e.g., an oil phase). The gas may include carbon dioxide, nitrogen, hydrogen sulfide and/or light aliphatic chains such as methane, ethane, propane, butane, etc.

Knowledge of the bubble point pressure is useful throughout the development and production of an oilwell. If bubbles are present in the porous rock and/or formation due to a reduction in the formation pressure, the permeability of a gas/oil mixture through the porous rock and/or formation may be reduced by several orders of magnitude, which creates a severe constriction on the reservoir's economic productivity. As a consequence, production rates may be limited and prior knowledge of the bubble point pressure may teach the oilwell operator the pressure to maintain on the reservoir to ensure safe and efficient production.

During production and/or as downhole fluid is brought to the surface, the pressure of the fluid drops, thereby causing the dissolved gas to segregate into a separate gas phase. The segregation of the separate gas phase should be performed in a controlled environment because hydrocarbon gas is flammable and compressible. Facilities that handle the gas-liquid separation during production are properly sized. Knowledge of the bubble point pressure, combined with prior knowledge of the pressure of the reservoir, its temperature, and the reservoir's approximate chemical composition, can help predict the size of production facilities needed to separate produced liquid and gas.

Condensate fluids may experience similar transitions downhole as the pressure drops below the DP pressure. However, instead of releasing gas, condensate fluids condense liquid dew into the formation or elsewhere, impeding production of the well. Knowledge of DP pressure is also useful throughout development and production.

Both saturation pressures (e.g., BP, DP) are of interest to oilfield operators to maximize the economics of their production strategy. Additionally, the Asphaltene Onset Pressure (AOP) may be of interest, because the AOP describes the pressure at which dissolved asphaltenes begin to flocculate and come out of solution. Asphaltene precipitation can impede production and/or flow by clogging the formation and/or flowlines.

Understanding the phase properties of formation oils and, specifically, the saturation pressure at the prevalent formation temperature is beneficial during oilwell production and/or analysis. Such analysis may take place at the surface or uphole (e.g., a laboratory). However, bringing the samples to the surface and/or storing them for long periods of time prior to analysis may cause irreversible changes in the composition and/or phase behavior of the fluid (e.g., asphaltene and/or wax precipitation). These irreversible changes make subsequent measurements of saturation pressure less accurate.

The examples disclosed herein can be used to perform saturation pressure measurements downhole and provide real-time downhole measurements and/or analysis of fluid samples obtained without the use of complex circulation pumps. Circulation pumps may emulsify immiscible downhole fluids. Specifically, the examples disclosed herein relate to methods and apparatus to enable thermally nucleated saturation pressure measurements in a downhole environment by thermally nucleating bubbles in a downhole fluid, detecting the subsequent property, characteristic and/or behavior of the downhole fluid and/or bubbles and controlling the pressure of the sample being tested. Using the examples disclosed herein, the apparatus may be sized to be implemented in a downhole tool having stringent space limitations. While the examples disclosed herein are described with reference to microfluidic devices, the examples may be more generally applicable to fluidic devices for use with downhole tools and/or in a downhole environment.

The examples disclosed herein may determine the saturation pressure by depressurizing a hydrocarbon sample in a controlled manner while monitoring the sample for the appearance of a permanent second phase (e.g., a gas phase). The surface tension between the two phases (e.g., a gas phase, a liquid phase) creates a nucleation barrier that kinetically inhibits the formation of a thermodynamically stable second phase. Such a nucleation barrier can introduce errors in the measured saturation pressure if sufficient care is not taken. Sensors used to accurately determine the BP pressure may include means for nucleating a bubble. A bubble may be nucleated mechanically (e.g., via an impeller), acoustically (e.g., using an ultrasonic actuator) and/or thermally (e.g., using an embedded heater). The nucleation barrier may be minimal when measuring the DP pressure, but thermal nucleation may nevertheless provide a more easily measurable transition. While thermal nucleation may enable the determination of the BP and/or DP, some thermal nucleation may create short-lived bubbles that are not below their thermodynamic saturation pressure. The appearance of a bubble may not indicate the BP, but rather, the BP may be indicated by long-term stability of such a bubble once nucleated.

In some examples, to thermally nucleate a bubble, resistive heating techniques and/or apparatus may be used. To locally heat a fluid sample, one or more wires having a relatively large cross-section may be used to transport current to a fine wire. Due to the substantially smaller cross-section of the wire, the current density increases dramatically with the associated consequence that the fine wire quickly heats. When a current pulse is passed through the system and/or wire, the small cross-section wire is locally heated which, in turn, locally increases the temperature of the fluid sample and can nucleate one or more bubbles within the fluid sample. The local increase in temperature depends on the cross-sectional area of the wire, the magnitude and/or duration of the current pulse (i.e., the amount of energy provided by the current pulse) and/or the resistivity of the wire and thermal conductivity of fluid in which the wire is immersed. Smaller wires may be used to create localized heat pulses because by using such wires the total energy needed to achieve a given temperature is smaller, the heating effects may be more localized and the system can more quickly return to the ambient temperature. Because the BP determination is based on the stability of the bubbles once nucleated, the system may quickly return to ambient temperature to enable the ambient temperature BP to be measured. Using the examples disclosed herein, thermally nucleating the sample may not substantially increase the temperature of the cell in which the sample is contained. In some examples, the temperature of the cell may not increase by more than approximately 0.1° C.

The amount of energy (heat) used to nucleate bubbles in the vicinity of a wire immersed in a fluid decreases monotonically with the wire diameter. Using a very fine wire enables the amount of heat (energy) used to nucleate bubbles in the vicinity of the wire to be minimized. Minimizing the total amount heat used during nucleation reduces the time for the system to return to ambient temperature. Reducing the total amount of heat may reduce the total volume of nucleated bubbles. The dissolution time of bubbles decreases as the volume of bubbles decreases. Thus, producing a smaller volume of bubbles reduces the time for bubbles to redissolve. The foregoing effects reduce an amount of time taken to determine whether a pressure is above or below the bubbles point.

In some examples, the wire may be suspended from conductive pins and/or attached to an insulating support and soldered and/or coupled thereto. Different wire configurations may be used to nucleate bubbles. The wire may be a short strand of relatively thin cylindrical wire. The wire may be a nickel-chromium alloy (e.g., Nichrome), nickel or platinum wire having a 25 um diameter that is soldered, laser welded, micro arc welded or otherwise coupled to leads. The wire may be an aluminum wire that is bonded directly to a ceramic circuit board. In other examples, a resistive temperature detector (RTD) can be used. The RTD may be a platinum electrode directly patterned on a substrate (e.g., a ceramic substrate).

In some examples, the wire discussed above can be used as a local temperature probe by measuring the resistance of the region and correlating the measured resistance with a known temperature dependence of resistivity (e.g., as in a resistive temperature detector (RTD)). An RTD may enable the temperature to be actively controlled to substantially ensure that temperatures high enough for bubble nucleation can be achieved without the risk of evaporating and/or damaging the resistive element. However, thermal nucleation may be achieved using a controlled heat pulse instead of an RTD.

Experiments may be performed on the fluid sample to determine the BP pressure and/or the DP. One such method, which may be referred to as constant composition expansion (CCE), is to expand the container volume of a fixed quantity of fluid. Some of the experiments may be performed using a static pressure step method and/or a controlled expansion method. For the static pressure step method, the pressure can be set at a given pressure and a nucleation and/or detection measurement can be performed. The pressure may be varied (e.g., decreased) in steps (e.g., discrete and/or predetermined steps) and the nucleation and/or detection measurements may be performed until the saturation pressure is reached. The static pressure step method may minimize and/or remove uncertainties associated with a time delay between nucleation and detection. For the static pressure step method, depressurization and nucleation and/or detection may be coordinated.

For the controlled expansion method, the pressure of the fluid sample may be substantially uniformly decreased by expanding the fluid sample while periodically inducing bubble nucleation. The sensitivity of the controlled expansion method may depend on the nucleation period, any delay and/or lag time between nucleation and detection and/or the fluid sample decompression rate. Depending on the method of expansion, there may be a flow associated with the measurements.

For the controlled expansion method, fluid flow through the example measurement device may depend on the position of the optical spectroscopy cell with respect to the expanding piston. If a large flow is desired, the optical spectroscopy cell may be positioned adjacent and/or next to the piston. The maximum flow rate may be set by the total motion of the piston. For an isolated system with dedicated valves and an expansion system, the maximum flow rate may be relatively small. For relatively large systems such as those used in reverse low shock sampling, the maximum flow rate may be relatively large depending on the relative position of the system and the piston.

Using the examples disclosed herein, a two-phase mixture with a known bubble point can be formulated by contacting the liquid phase (e.g., hexadecane) with a known pressure of gas (e.g., carbon dioxide or hexadecane). To determine the bubble point, the liquid is saturated with the gas at the regulated pressure by mixing for a sufficient equilibrium time. By extracting a portion of the saturated liquid phase, a sample having a known bubble point may be obtained. The extracted sample can then be used for experimental measurements.

For experiments at low pressures, the examples disclosed herein may be implemented using a transparent tube with a 25 um Nichrome wire positioned and/or inserted therein. The transparent tube may be made of any suitable material such as sapphire. The wire may be soldered or otherwise coupled to pins. The pins may be soldered or otherwise coupled to larger wires that are coupled to a power supply. The wire may have any suitable resistance such as, for example, 1 ohm. To seal an end of the tube, the wires and tube may be encapsulated and/or epoxied to a barbed fitting. In some examples, a fitting may be included on the other end of the tube and the system can be connected to a pressure gauge, a syringe on a syringe pump (e.g., a high-pressure syringe) and a plurality of valves. The valve can be used to isolate the sample volume. In one example, a fluid sample of hexadecane equilibrated with 50 psi of carbon dioxide may be used. To heat the sample and nucleate bubbles therein, current pulses having a duration of 100 ns-100 ms may be passed through the wire.

A syringe and/or piston in fluidic communication and/or fluidly coupled to the sample chamber may be used to control the pressure of the sample. At approximately 40 psi, each nucleated bubble grows and collects near a high point of the cell where a gas pocket may be observed. When the pressure is approximately 60 psi, the nucleated bubbles may form and quickly disappear with no visible gas in the cell.

In some examples, a high pressure cell with ceramic feedthroughs may be used to implement the examples disclosed herein. In such examples, a wire may be bonded or otherwise coupled to bond pads. The wire may be any suitable diameter such as 25 um and may be made of any suitable material such as aluminum, platinum, gold, nichrome, for example. The total resistance of the feedthrough and wire bond may be, for example, 0.1, 0.5, 1 or 5 ohms. The high pressure cell may include a main flowline and two oppositely positioned high pressure sapphire windows. The flowline may have any suitable diameter such as 0.25, 0.55, 1, 2.5 or 5 mm, for example. The wire may be positioned adjacent and/or directly underneath the flowpath between the two sapphire windows. The wire bond may be oriented at the bottom of the optical cell to enable generated bubbles to travel up and into the optical path.

Some example experiments were performed using a two-component mixture of hexadecane and methane having a room-temperature saturation pressure of approximately 2260 psi at room temperature. The sample was prepared in a conventional sample bottle (CSB) by contacting hexadecane with 2260 psi of methane. The hexadecane was allowed to equilibrate with the methane until saturated with methane. After the hexadecane was saturated with methane, the saturated fluid was sampled into a second CSB containing the saturated liquid. Loading only the liquid portion of the equilibrated sample enables the second CSB to be pressurized without changing the saturation pressure. From the CSB, the saturated liquid was flowed through a fluid path to a third CSB where waste fluid is collected. The fluid path may contain a pressure gauge, valves, a high pressure piston and/or a high pressure cell. Both the sample and waste CSB are maintained at a pressure above the saturation pressure (2260 psi) to ensure that the saturated liquid remains in a single phase. Once sufficient fluid flowed through the high pressure cell, the high pressure cell, high pressure piston and/or pressure gauge may be isolated from the sample and waste CSBs by closing valves. In some examples, the sample pressure is controlled by adjusting the sample volume using the high pressure piston.

In some of the experiments, measurements were taken in the high pressure cell by slowly depressurizing the fluid sample. Initially, the fluid sample was pressurized to 3000 psi and then pressure was slowly lowered to 2000 psi at a rate of approximately 1 psi/sec. During depressurization, the heater and/or wire was pulsed at approximately 1 Hz with 30 microsecond pulses of 10 Amperes. At pressures slightly above the saturation pressure, the heat pulse created small bubbles, producing a small but detectable decrease in optical transmission, indicating a decrease in fluid and/or optical transmissivity. These bubbles were temporary and observed to shrink away in substantially less than one second. As the pressure was decreased further, at approximately 2260±10 psi, the bubbles were observed to grow after nucleation, greatly decreasing the optical transmission. In the absence of thermal nucleation, bubbles were only observed to form at considerably lower pressures. The measured saturation pressure is normally higher with thermal nucleation as compared to without thermal nucleation, indicating the presence of a nucleation barrier to the formation of bubbles. The nucleation barrier is normally larger as temperature decreases away from the critical temperature. A large nucleation barrier is indicative of a black oil, whereas a small nucleation barrier is consistent with a near-critical fluid or a condensate.

Additional measurements and/or the optical transmission through the cell (as measured by the intensity of light transmission, sometimes denoted as optical intensity) may be used to distinguish condensation from bubble formation. In some examples, the term "optical" as used herein includes wavelengths of electromagnetic radiation (such as visible light) extending beyond that of the visible range, for example, including but not limited to the region referred to as near infrared. For condensates, an observed optical transmission may have a strong dependence on decompression speed. Repeating a measurement at different compression speeds and observing a depth of the optical transmission can be used to distinguish and/or discriminate condensation from bubble formation. In some examples, condensation may be distinguished from a bubble based on a density of the sample, a viscosity of the sample, a decompression speed dependence of the optical transmission decrease at saturation pressure, or a change in compressibility at saturation pressure.

The examples disclosed herein enable measurements of an AOP transition. The AOP transition may be detected by a decrease in optical transmission before the bubble point is reached.

In some examples, a nucleation cell may be used to implement the examples disclosed herein. The nucleation cell may include an optical cell having a flowline with two windows or lenses (e.g., spherical sapphire lenses, ball lenses). The ball lenses enable light to be focused onto a single fiber and may or may not be positioned behind a flat window. The ball lenses enable an increased optical transmission, which may enable a higher dynamic range to be measured.

To enable the identification of a first onset of BP, DP and/or AOP, in some examples, a focusing lens is coupled with a 'pinhole effect' of a single small fiber to collect the light. The 'pinhole effect' may contribute to an increase in sensitivity of the optical transmission measurement. The lens may be behind a pressure window (e.g., a flat pressure window) or the lens may be immersed in fluid directly. The flowline may be any suitable length such as 0.5, 0.75, 1 or 2 millimeters (mm). The optical path may be highly sensitive to the presence of fluid interfaces such as those associated with bubbles in liquid produced at BP or liquid droplets in a gas produced at DP.

To thermally agitate the fluid to overcome the nucleation barrier, a wire may be installed in the optical cell orthogonal to the flowpath. In some examples, the wire may be 80% Nickel and 20% Chromium (e.g., Nichrome80) and have a diameter of approximately 25 μm or the wire may be platinum and have a diameter of approximately 25 μm. However, wires made of any suitable material and having any suitable diameter and/or cross-section may be used instead. In other examples, a nucleating wire may be placed inside an optical spectroscopy cell (e.g., a microfluidic optical spectroscopy cell), where the optical path is perpendicular to the flowpath. Using a relatively thin nucleation wire, the optical spectroscopy cell may be sensitive to nucleation and/or growth of bubbles from their creation until the fluid flow moves and/or convects them beyond the optical path.

Nucleation occurs by temporarily perturbing the fluid from its stable configuration using a fast heat pulse. Heat may dissipate quickly enabling the system to return to ambient temperature before the nucleated bubbles have dissolved into the surrounding fluid.

In some examples, during the depressurization stage, the optical transmission through the nucleation cell is monitored. The bubble point is easily detectable when the optical transmission through the fluid sample decreases substantially. In some examples, when thermal nucleation is applied, the optical transmission decreases suddenly at approximately 3940 psi. However, when thermal nucleation is not applied, the optical transmission decreases suddenly at approximately 3800 psi. Thermal nucleation enables the nucleation barrier to be overcome and, thus, for bubbles to be produced. The quantity of bubbles produced at the thermodynamic bubble point via thermal nucleation is sufficiently small that their effects may only be detectable in the nucleation cell. However, if the system is further depressurized without thermal nucleation causing the system to be supersaturated, bubble nucleation may spontaneously occur throughout the measurement system at a pressure below that of the true thermodynamic bubble point. Thermal nucleation enables this lower pressure to not be incorrectly and/or inadvertently identified as the true thermodynamic bubble point.

The examples disclosed herein may monitor and/or observe optical transmission recovery to differentiate between bubble point and bubble nucleation. An indication that the fluid sample is above the bubble point is associated with a sharp optical transmission decrease followed by a relatively fast optical transmission recovery indicative of bubble creation and dissolution. A sharp optical transmission decrease with no recovery may be associated with the the sample being at or below bubble point pressure, indicative of stable bubble formation.

The examples disclosed herein enable heat to be applied to a very small volume of fluid while substantially simultaneously monitoring the optical intensity of a beam of light directed through the bubbles, while not appreciably adding to the dead volume of the fluid and achieving a relatively high pressure rating.

One of the examples disclosed herein may include electrical pins positioned in a high pressure housing in which a fluid sample (e.g., a dead volume) is to be positioned. To measure and/or monitor the fluid sample and enable light to pass through the housing, focusing optics and/or two ball lenses (e.g., sapphire windows) may be secured via glands (e.g., fiber ball retainers). In some examples, the focusing optics are immersed in the flowline and/or are coupled using a single fiber as a 'pinhole aperture' to enhance BP, DP and AOP measurements. The housing may be sealed using relatively small O-rings. The electrical pins may be secured by two secured half cylinders of anodized, insulated aluminum. The wire may be soldered to the pins. The fluidic path may be substantially and/or largely defined by channels through the pressure housing block. The window used to implement the examples disclosed herein may have any suitable shape and may or may not be symmetrical (e.g., spherical symmetry).

In some of the examples disclosed herein, an example feedthrough device may define a fluidic path. The electrical pressure feedthrough may be made of Polyether ether keton (PEEK) and include two metal electrical pins. A wire between the electrical pins may be positioned orthogonal to the channel. In this example, the channel and the housing (e.g., a metal housing) define a fluidic path. This example also includes a sapphire ball lens. The electrical pressure feedthrough may be formed by a glass sealed and insulated pins. The electrical pressure feedthrough may include an electrical pin sealed by an O-ring and backed by a gland.

In some of the examples disclosed herein, sapphire windows may define a fluidic path. In such examples, the windows may each include a groove that, when positioned adjacent one another in an example pressure housing, define a fluidic path. The wire may be positioned orthogonal to the fluidic path. In some examples, a coating (e.g., a metal coating) may be positioned around the region of interest to block light.

In some examples, metal traces and/or wires may be deposited on a non-conductive substrate. Deposited traces may have considerably smaller cross-sections than any practical isolated wire, thereby enabling greater resistance and/or more sensitive heating and/or detection. Depositing traces on a non-conductive substrate may also enable a resistance path to be carefully controlled and provide a relatively straightforward implementation of a four-probe configuration for temperature feedback control. In some examples, to protect the deposited metal traces from the surrounding fluid, the traces can be encapsulated and/or covered with a protective material. The resistive wires and/or substrate may be isolated to reduce the total thermal mass and/or to produce a relatively fast thermal response.

Once nucleated, the behavior of the bubble in the fluid sample is observed and/or interrogated. For example, optical scattering is a method that can be used to implement the examples disclosed herein. Optical scattering is highly sensitive to a liquid-vapor interface and can detect small and/or minute amounts of gas in a liquid or small and/or minute amounts of liquid droplets in gas. Additionally or alternatively, dielectric contrast measurements, acoustic compressibility contrast measurements, optical transmissivity measurements, thermal conductivity measurements and/or acoustic impedance measurements can be used to implement the examples disclosed herein.

If optical detection is used to implement the examples disclosed herein, there are a plurality of possible configurations that can be used to determine the BP downhole depending on the size of the flowline and/or nucleation method used. Once nucleated, the bubble may not remain in the vicinity of the heater electrode. Thus, the optical detection device may be coupled to the apparatus to enable the detection of the nucleated bubble.

In some examples, a bubble trap is created in a flowline to enable the detection of nucleated bubbles. Such a flowline may enable liquid to pass through, but the bubble trap traps and/or collects one or more of the bubbles formed. The bubble trap may be optically interrogated to determine the presence and/or growth of bubbles. If the direction of the gravitational force is known (e.g., based on the intended position of the apparatus within the downhole tool), the trap may include a reservoir that is peaked with respect to gravity (e.g., the reservoir is positioned at the top of the trap to enable bubbles to rise and be trapped therein). If there is sufficient fluid flow, a trap can be made by creating a relatively wide region in the flowline where the bubbles become trapped because of buoyancy and/or surface tension. The nucleation electrodes may be coincident with the bubble trapping region to increase the likelihood that a bubble is trapped. The bubble traps described above may be used in larger flowlines where the bubble tends to be substantially smaller than the total chamber diameter. Additionally or alternatively, the above-noted bubble traps may be used in microfluidic and/or millifluidic devices.

In some examples, if a fluid flow of known direction and magnitude (e.g., a consistent flow) can be imposed on the bubble, the bubble may be interrogated, observed and/or analyzed at successive portions of the flowpath to determine the relative size of the bubble over time. Such an interrogation method may be sensitive to the entire flowline region and/or may rely on the bubbles being sufficiently large for slug flow to occur. Such an interrogation method can be used over a wide range of flowline sizes (e.g., lengths).

For clean oils, bubbles may be trapped using a porous frit. The frit enables liquid to flow freely therethrough but surface tension prevents the bubble from passing through the frit. The fluid sample may be over pressured after nucleation to redissolve the bubbles and remove them from the frit after analysis is complete.

To measure the BP pressure, the fluid pressure may be controlled. A fixed volume of formation fluid may be isolated using a piston or other mechanical apparatus that enables a total volume of a sample chamber and/or bottle to be changed.

In some examples, a majority and/or the entire example pressure control apparatus is contained within an example measurement device. The pressure control apparatus and/or the example measurement device may include two or more fluid control devices and/or valves used to isolate the fluid sample, a motorized piston moveable to adjust a total volume between the valves and a pressure gauge. Such a self-contained apparatus and/or system enables the pressure of the fluid sample to be controlled and minimizes the total volume of the sample.

The examples disclosed herein may be implemented using reverse low shock sampling (RLSS) techniques. With RLSS, hydraulic fluid may be used to move a piston in a sample chamber and/or bottle. Movement of the piston draws and/or expels a fluid sample from a flowline (e.g., a main flowline). Once obtained, a valve may isolate the fluid sample in a sample bottle and/or flowline, after which the pressure of the sample can be varied and/or controlled. The sensitivity of the pressure control may depend on the compressibility of the fluid sample, the volume of the flowline and/or the total travel of the piston (e.g., the hydraulic piston).

FIG. 1 depicts an example wireline tool 151 that may be an environment in which aspects of the present disclosure may be implemented. The example wireline tool 151 is suspended in a wellbore 152 from the lower end of a multiconductor cable 154 that is spooled on a winch (not shown) at the Earth's surface. At the surface, the cable 154 is communicatively coupled to an electronics and processing system 156. The example wireline tool 151 includes an elongated body 158 that includes a formation tester 164 having a selectively extendable probe assembly 166 and a selectively extendable tool anchoring member 168 that are arranged on opposite sides of the elongated body 158. Additional components (e.g., 160) may also be included in the wireline tool 151.

The extendable probe assembly 166 may be configured to selectively seal off or isolate selected portions of the wall of the wellbore 152 to fluidly couple to an adjacent formation F and/or to draw fluid samples from the formation F. Accordingly, the extendable probe assembly 166 may be provided with a probe having an embedded plate. The formation fluid may be expelled through a port (not shown) or it may be sent to one or more fluid collecting chambers 176 and 178. The example wireline tool 151 also includes an example apparatus 180 that may be used to determine downhole the bubble point pressure and/or dew point of formation fluids, for example. As discussed in more detail below, the apparatus 180 may include an optical path, one or more sensors (e.g., optical sensors, spectrometers, etc.), a pressure control apparatus and one or more heaters that are used to thermally nucleate bubbles in a fluid sample and observe the behavior of the bubble to determine the bubble point pressure and/or dew point of the fluid. In the illustrated example, the electronics and processing system 156 and/or a downhole control system are configured to control the extendable probe assembly 166, the apparatus 180 and/or the drawing of a fluid sample from the formation F.

Figure 2:
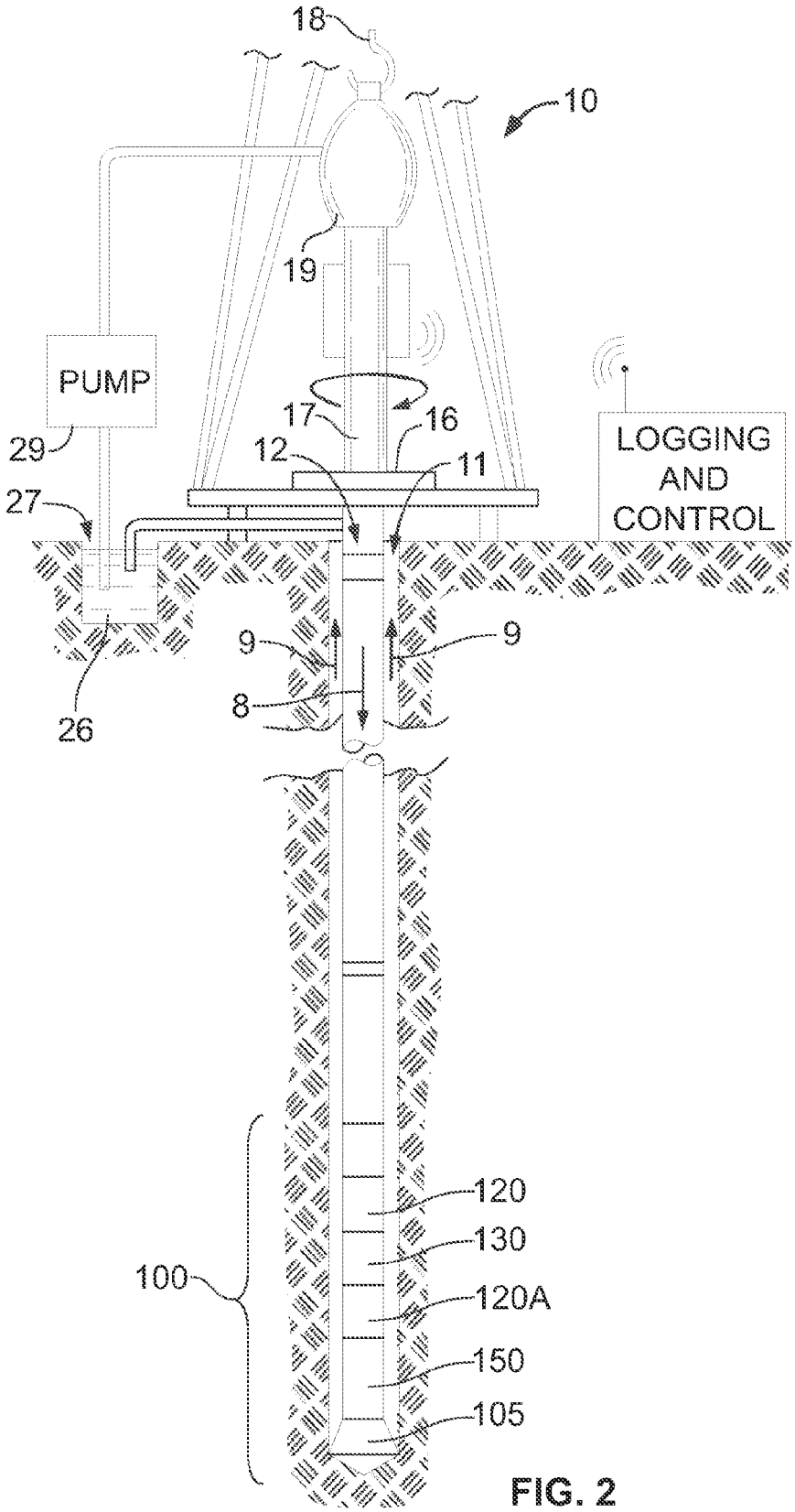
FIG. 2 illustrates another example system in which embodiments of the systems and methods of determining parameter values in a downhole environment can be implemented.

FIG. 2 illustrates a wellsite system in which the examples described herein can be employed. The wellsite can be onshore or offshore. In this example system, a borehole 11 is formed in subsurface formations by rotary drilling in a manner that is well known. However, the examples described herein can also use directional drilling, as will be described hereinafter.

A drill string 12 is suspended within the borehole 11 and has a bottom hole assembly 100 which includes a drill bit 105 at its lower end. The surface system includes a platform and derrick assembly 10 positioned over the borehole 11. The assembly 10 includes a rotary table 16, a kelly 17, a hook 18 and a rotary swivel 19. The drill string 12 is rotated by the rotary table 16 and energized by means not shown, which engages the kelly 17 at the upper end of the drill string 12. The drill string 12 is suspended from the hook 18, attached to a traveling block (also not shown), through the kelly 17 and the rotary swivel 19, which permits rotation of the drill string 12 relative to the hook 18. As is well known, a top drive system could alternatively be used.

In this example, the surface system further includes drilling fluid or mud 26 stored in a pit 27 formed at the well site. A pump 29 delivers the drilling fluid 26 to the interior of the drill string 12 via a port in the swivel 19, causing the drilling fluid 26 to flow downwardly through the drill string 12 as indicated by the directional arrow 8. The drilling fluid 26 exits the drill string 12 via ports in the drill bit 105, and then circulates upwardly through the annulus region between the outside of the drill string 12 and the wall of the borehole 11, as indicated by the directional arrows 9. In this manner, the drilling fluid 26 lubricates the drill bit 105 and carries formation cuttings up to the surface as it is returned to the pit 27 for recirculation.

The bottom hole assembly 100 includes a logging-while-drilling (LWD) module 120, a measuring-while-drilling (MWD) module 130, a roto-steerable system and motor 150, and the drill bit 105.

The LWD module 120 is housed in a special type of drill collar, as is known in the art, and can contain one or a plurality of known types of logging tools. It will also be understood that more than one LWD and/or MWD module can be employed, e.g. as represented at 120A. (References, throughout, to a module at the position of 120 can alternatively mean a module at the position of 120A as well.) The LWD module includes capabilities for measuring, processing, and storing information, as well as for communicating with the surface equipment. In this example, the LWD module 120 includes a fluid sampling device.

The MWD module 130 is also housed in a special type of drill collar, as is known in the art, and can contain one or more devices for measuring characteristics of the drill string and drill bit. The MWD tool further includes an apparatus (not shown) for generating electrical power for the downhole system. This may include a mud turbine generator powered by the flow of the drilling fluid 26. However, other power and/or battery systems may be employed. In this example, the MWD module 130 includes one or more of the following types of measuring devices: a weight-on-bit measuring device, a torque measuring device, a vibration measuring device, a shock measuring device, a stick slip measuring device, a direction measuring device, and an inclination measuring device.

Figure 3:
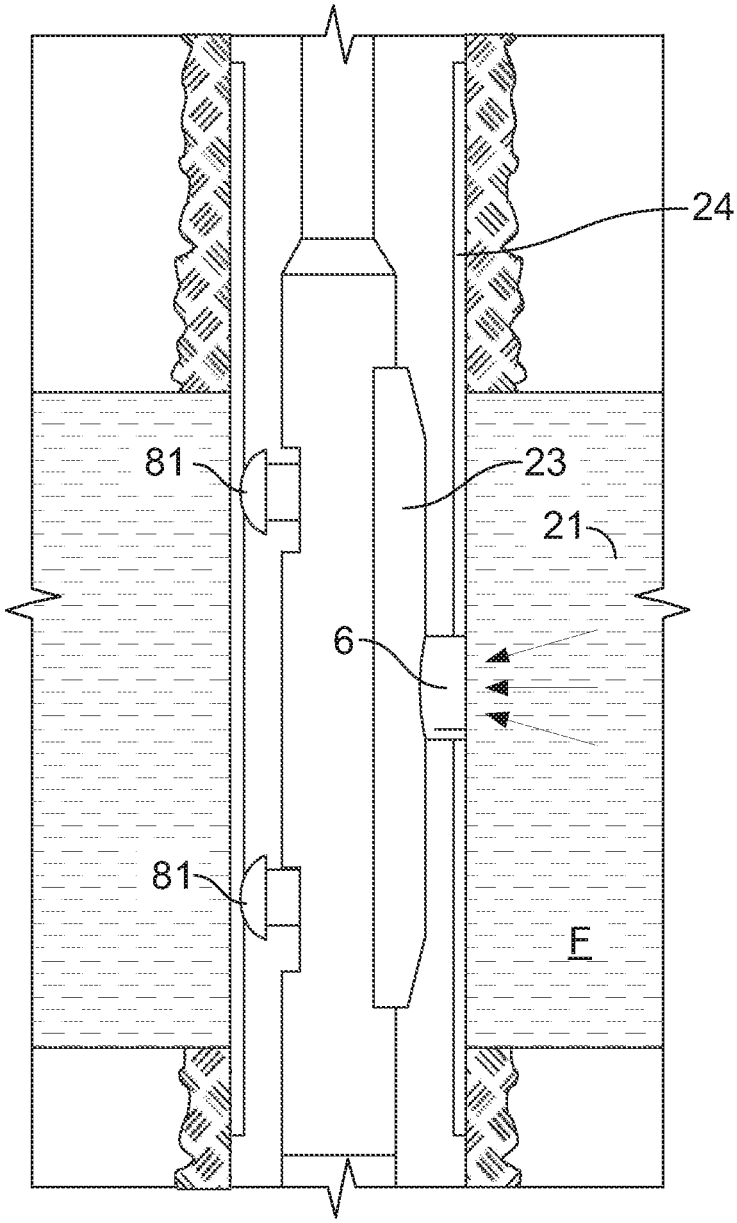
FIG. 3 illustrates another example system in which embodiments of the systems and methods of determining parameter values in a downhole environment can be implemented.

FIG. 3 is a simplified diagram of a sampling-while-drilling logging device of a type described in U.S. Pat. No. 7,114,562, incorporated herein by reference, utilized as the LWD module 120 or part of a LWD tool suite 120A. The LWD module 120 is provided with a probe 6 for establishing fluid communication with a formation F and drawing fluid 21 into the tool, as indicated by the arrows. The probe 6 may be positioned in a stabilizer blade 23 of the LWD module 120 and extended therefrom to engage a borehole wall 24. The stabilizer blade 23 comprises one or more blades that are in contact with the borehole wall 24. Fluid drawn into the downhole tool using the probe 6 may be measured to determine, for example, pretest and/or pressure parameters. Additionally, the LWD module 120 may be provided with devices, such as sample chambers, for collecting fluid samples for retrieval at the surface. Backup pistons 81 may also be provided to assist in applying force to push the drilling tool and/or probe against the borehole wall 24.

Figure 4:
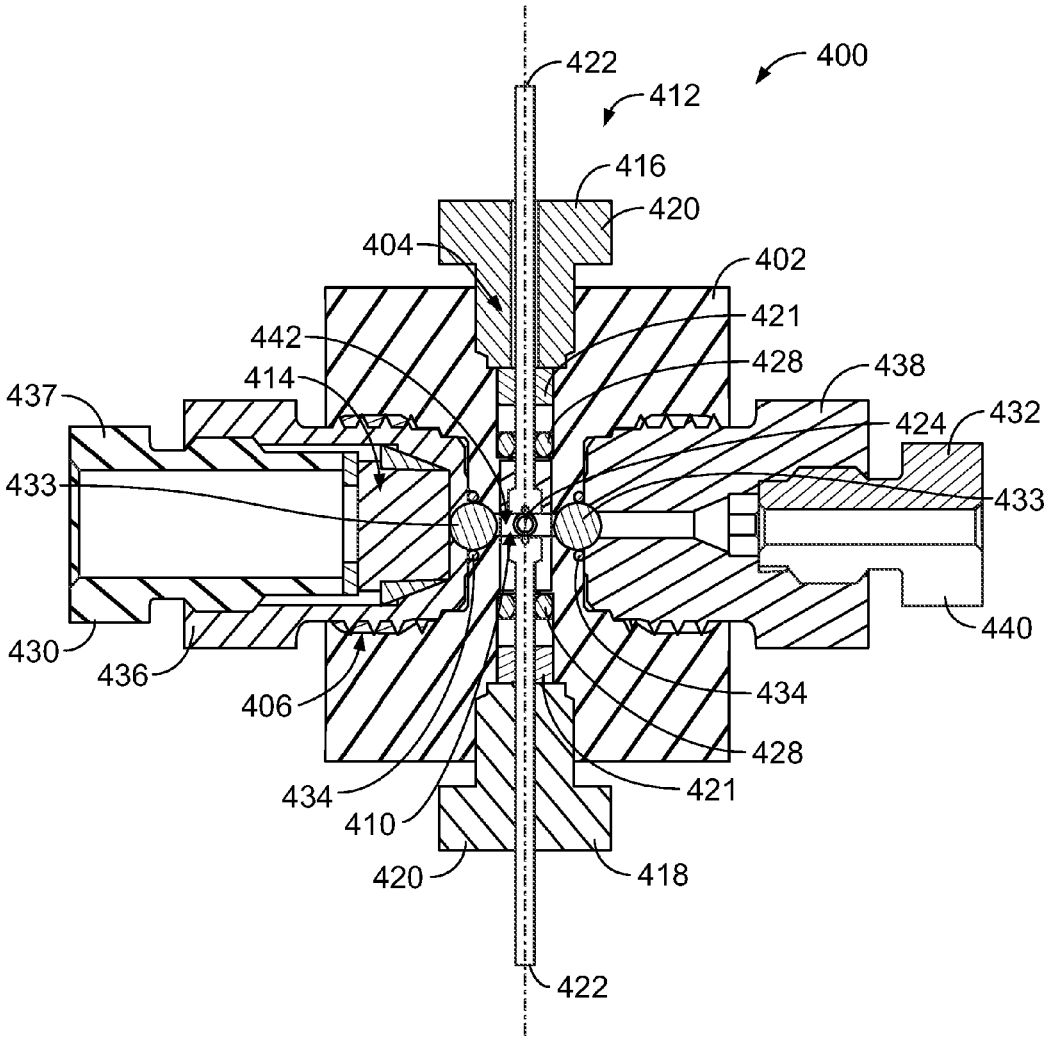
FIGS. 4-6 illustrate various components of an example device that can implement embodiments of the systems and methods of determining parameter values in a downhole environment.
Figure 5:
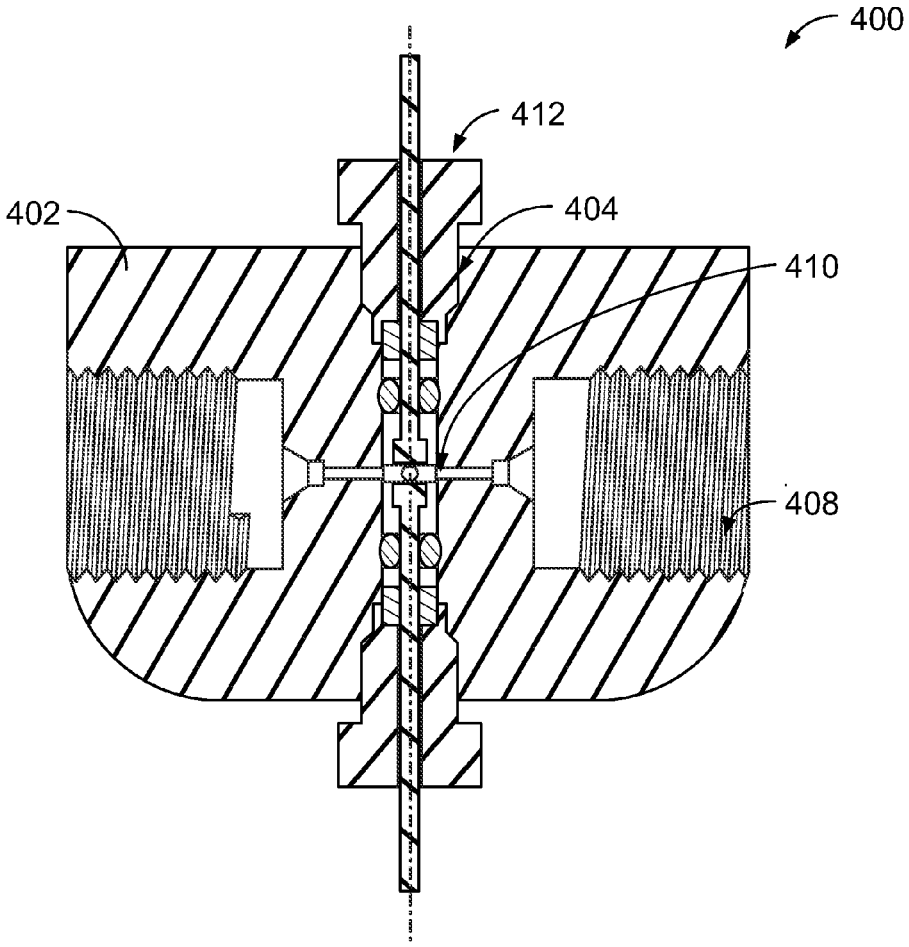
Figure 6:
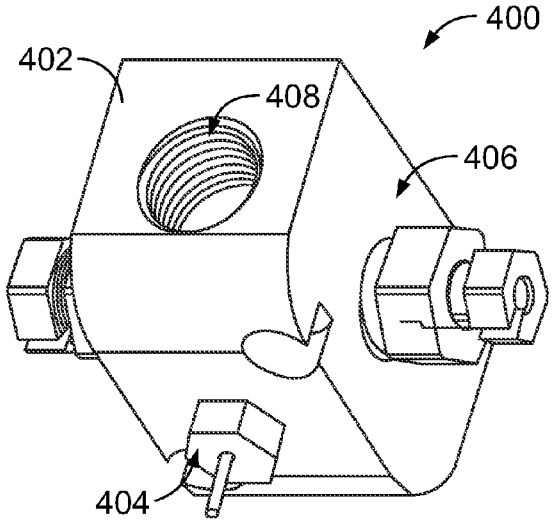
Figure 7:
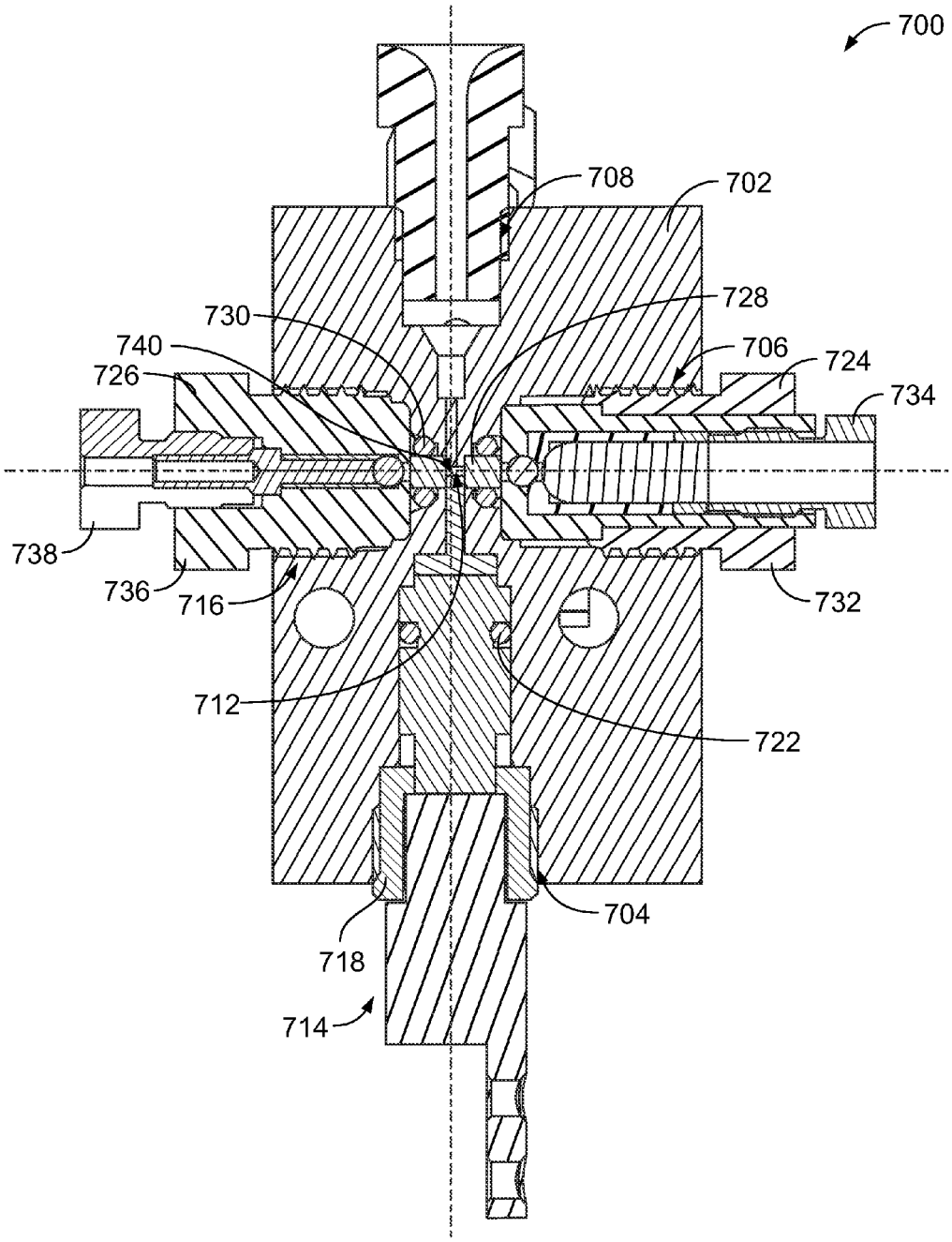
FIGS. 7-10 illustrate various components of another example device that can implement embodiments of the systems and methods of determining parameter values in a downhole environment.

FIGS. 4-6 depict an example apparatus and/or cell 400 that can be used to implement the examples disclosed herein. The example apparatus 400 includes a heater block or high pressure housing 402 defining a first passage or aperture 404, a second passage or aperture 406 and a third passage or aperture 408 (FIG. 5). The passages 404-408 intersect adjacent a flowpath and/or sample and/or optical or detection chamber 410 that may be substantially defined by the heater block 402. The first passage 404 receives and/or partially houses a heater assembly 412, the second passage 406 receives and/or partially houses a sensor assembly 414 and the third passage 408 is a fluid inlet and/or outlet to the flowpath 410 where a fluid sample is to be analyzed.

In this example, the heater assembly 412 includes first and second opposing portions 416 and 418. The portions 416 and 418 each include a heater pin retainer or retainer 420 and a ceramic ring 421 that surrounds the respective retainer 420. The retainer 420 may be a half cylinder of anodized, insulated aluminum. The heater assembly 412 also includes a heater or electrical pin 422 that extends through the retainer 420 and to which a wire 424 is coupled. The wire 424 extends between the heater pins 422. O-rings 428 surround the heater pins 422 to substantially ensure that the fluid sample remains within the flowpath 410.

In this example, the sensor assembly 414 includes first and second portions 430 and 432. The first and second portions 430 and 432 each include a lens and/or sapphire ball 433 surrounded by an O-ring 434. The portion 430 also includes a first gland or retainer (e.g., a photo diode ball retainer) 436 that secures the lens 433 and/or the O-ring 434 relative to the flowpath 410. The first retainer 436 is coupled to and/or receives a second retainer (e.g., a photo diode retainer) 437 that is to receive and/or retain a sensor and/or photo diode relative to the flowpath 410. The second portion 432 includes a third gland or retainer (e.g., a lens and/or fiber retainer) 438 that secures its respective lens 433, O-ring 434 and/or an optic fiber relative to the flowpath 410. The third retainer 438 is coupled to and/or receives a fourth retainer (e.g., a fiber retainer) 440 that is to receive and/or retain an optic fiber relative to the flowpath 410.

In operation, a fluid sample is introduced into the flowpath 410 via the third passage 408 and retained and/or isolated therein via valves (not shown). Current is passed through the wire 424 to thermally nucleate bubbles in the fluid such that the bubbles can be detected in an optical path 442 between the lenses 433 using a sensor (not shown). Depending on the behavior of the bubble(s), a determination can be made whether or not the bubble point has been reached. If the bubble point has not been reached based on the behavior of the nucleated bubble(s), a pressure of the fluid sample in the flowpath 410 may be decreased. This decrease in pressure may be performed incrementally, in steps and/or continuously as bubbles are thermally nucleated in the sample.

Figure 8:
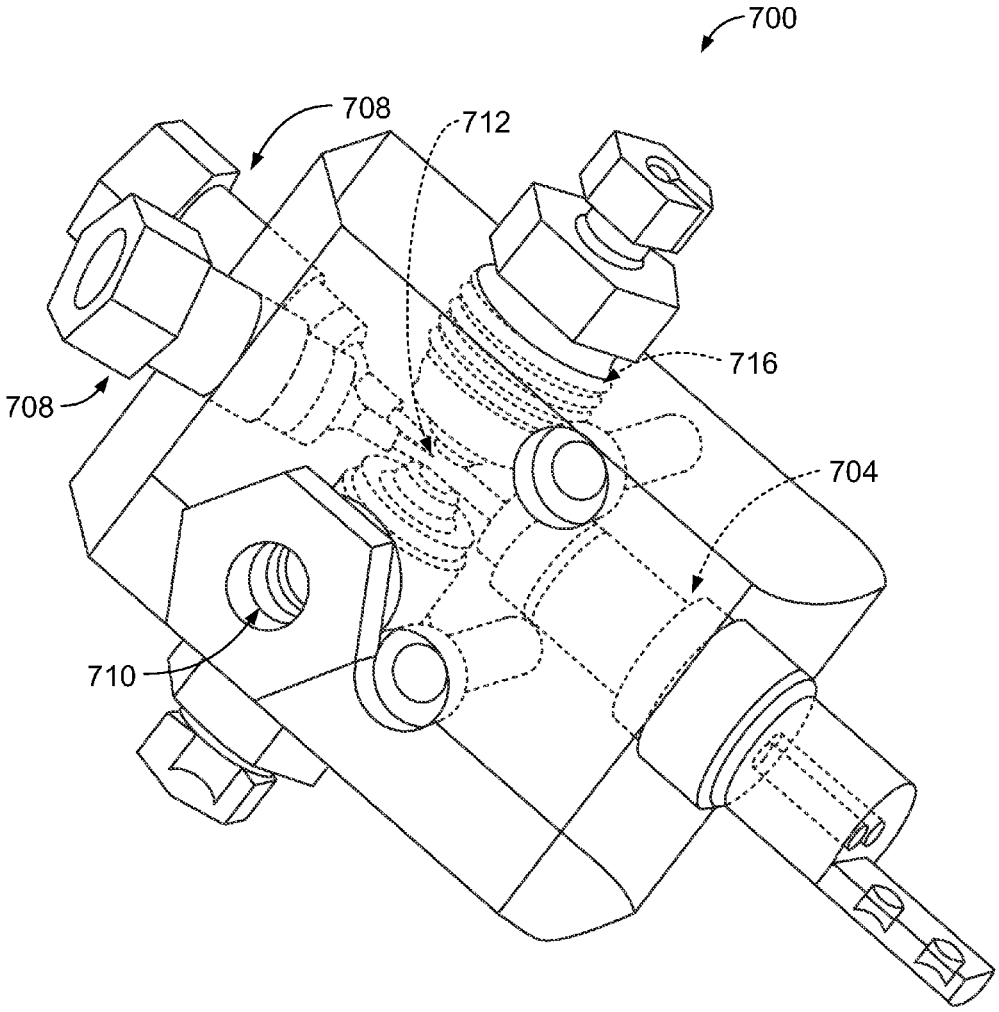
Figure 9:
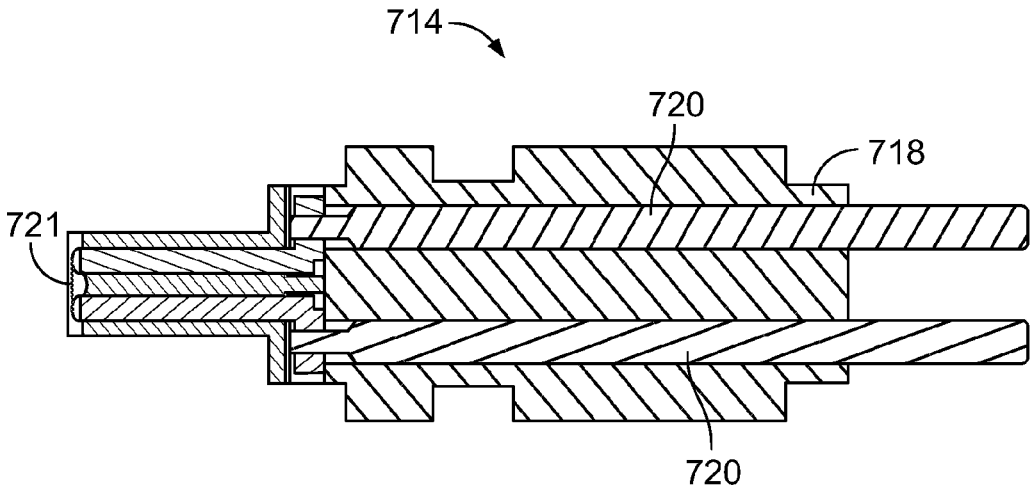
Figure 10:
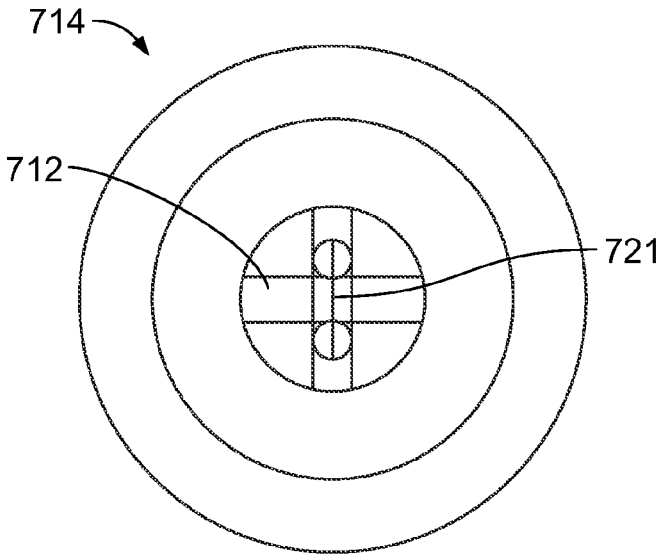

FIGS. 7-10 depict an example apparatus and/or cell 700 that can be used to implement the examples disclosed herein. The example apparatus 700 includes a heater block or high pressure housing 702 defining a first passage or aperture 704, a second passage or aperture 706, a third passage or aperture 708 and a fourth passage or aperture 710 (FIG. 8). One or more of the passages 704-710 intersect adjacent a flowpath and/or sample and/or optical or detection chamber 712. The first passage 704 receives and/or partially houses a heater assembly 714 and the second passage 706 receives and/or partially houses a sensor assembly 716. The sensor assembly 716 at least partially defines the flowpath 712. The third passage 708 is a fluid inlet and/or outlet to the flowpath 712 where a fluid sample is to be analyzed and the fourth passage 710 may be fluidly coupled to a pressure controller to control the pressure of the fluid sample within the flowpath 712.

In this example, the heater assembly 714 includes a retainer 718 and a plurality of heaters or electrical pins 720 (FIG. 9) that extend through the retainer 718 and to which a wire 721 (FIG. 9) is coupled. The wire 721 extends between the heater pins 720 and is positioned orthogonal to the flowpath 712. An O-ring 722 surrounds the heater pins 720 to substantially ensure that the fluid sample remains within the flowpath 712. The heater assembly 714 is relatively large and fittingly engages at least partially within the housing 702. In this example, the heater assembly 714 defines the flowpath 712 having a relatively small volume. Thus, the heater assembly 714 and the housing 702, both of which may be relatively large components, may be fabricated with high tolerances and a relatively small groove defined (e.g., the flowpath 712) to create microfluidic passage having a very small volume.

In this example, the sensor assembly 716 includes first and second portions 724 and 726. The first and second portions 724 and 726 each include a lens 728 surrounded by an O-ring 730. The portion 724 also includes a first gland or retainer (e.g., a photo diode ball retainer) 732 that secures the lens 728 and/or the O-ring 730 relative to the flowpath 712. The first retainer 732 is coupled to and/or receives a second retainer (e.g., a photo diode retainer) 734 that is to receive and/or retain a sensor and/or photo diode (not shown) relative to the flowpath 712. The second portion 726 includes a third gland or retainer (e.g., a lens and/or fiber retainer) 736 that secures the lens 728, the O-ring 434 and/or an optic fiber relative to the flowpath 712. The third retainer 736 is coupled to and/or receives a fourth retainer (e.g., a fiber retainer) 738 that is to receive and/or retain an optic fiber relative to the flowpath 712.

In operation, a fluid sample is introduced into the flowpath 712 via the third passage 708 and retained and/or isolated therein via valves (not shown). Current is passed through the wire 721 to thermally nucleate bubbles in the fluid which can be detected in an optical path 740 between the lenses 728 using a sensor (not shown). Depending on the behavior of the bubble(s) (e.g., whether the bubbles are stable or collapse), a determination can be made whether or not the bubble point has been reached. If the bubble point has not been reached based on the behavior of the nucleated bubble(s), a pressure of the fluid sample in the flowpath 712 may be deceased using a pressure controller fluidly coupled to the fourth passage 710. This decrease in pressure may be performed incrementally, in steps and/or continuously as bubbles are thermally nucleated in the sample.

Figure 11:
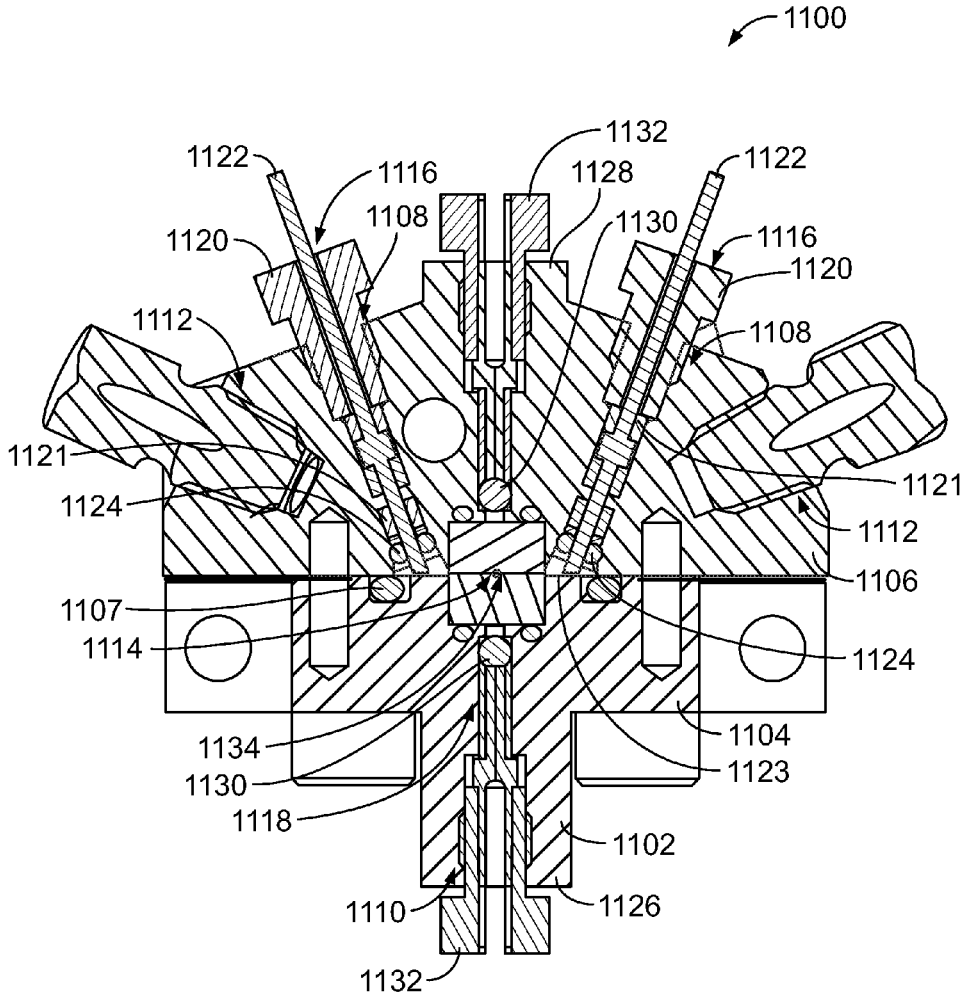
FIGS. 11-13 illustrate various components of an example device that can implement embodiments of the systems and methods of determining parameter values in a downhole environment.
Figure 12:
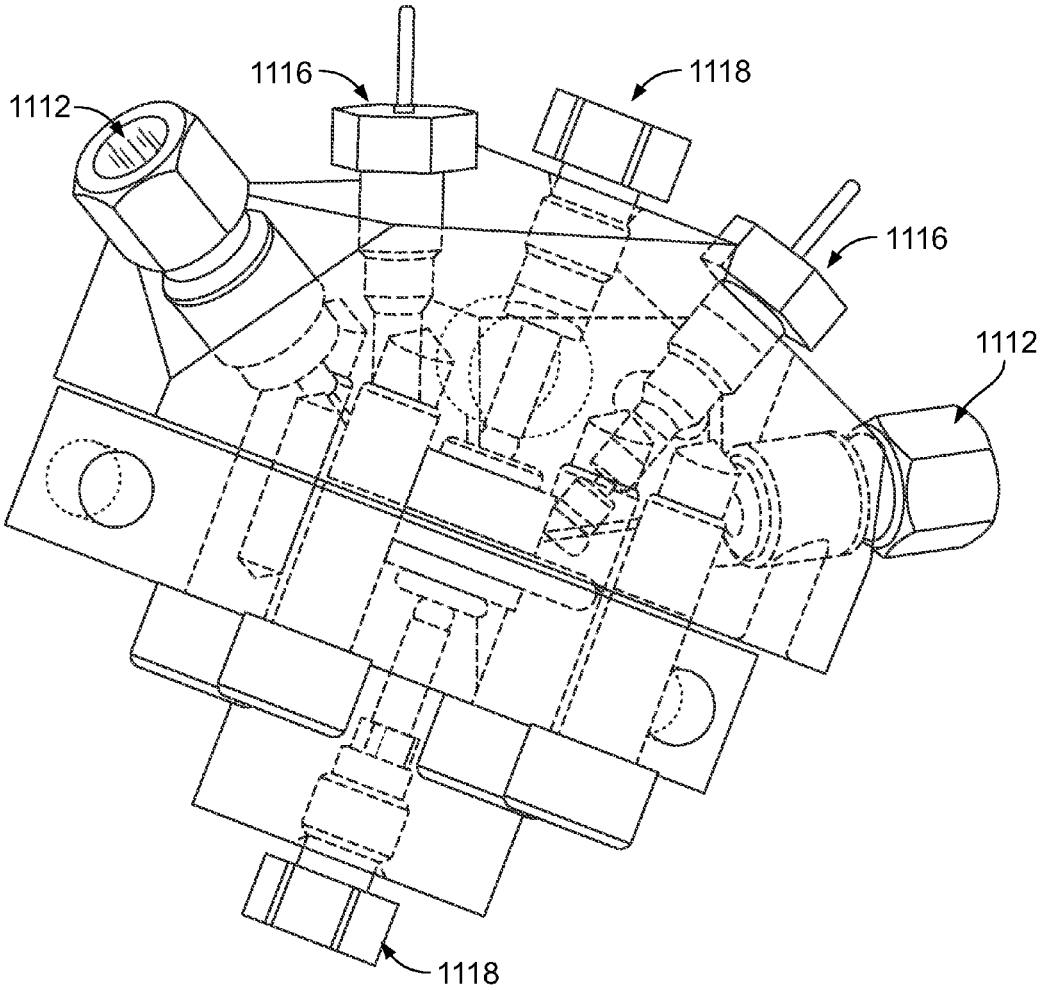

FIGS. 11-12 depict an example apparatus and/or cell 1100 that can be used to implement the examples disclosed herein. The example apparatus 1100 includes a heater block or high pressure housing 1102 including a first portion 1104 coupled to a second portion 1106. In some examples, an O-ring 1107 is positioned in groove between the portions 1104 and 1106. The housing 1102 defines first passages or apertures 1108, a second passage or aperture 1110 and third passages or apertures 1112. One or more of the passages 1108-1112 intersect adjacent a flowpath and/or sample chamber 1114. The first passages 1108 receive and/or partially house a heater assembly 1116 and the second passage 1110 receives and/or partially houses a sensor assembly 1118. The sensor assembly 1118 at least partially defines the flowpath 1114. The third passages 1112 are a fluid inlet and/or outlet to the flowpath 1114 where a fluid sample is to be analyzed.

In this example, the heater assembly 1116 includes retainers 1120 and a plurality of heater or electrical pins 1122 that extend through the respective retainer 1120 and ceramic beads 1121 and to which a wire 1123 is coupled. The wire 1123 extends between the heater pins 1122 and is orthogonal to the flowpath 1114. O-rings 1124 surround the heater pins 1122 to substantially ensure that the fluid sample remains within the flowpath 1114.

Figure 13:
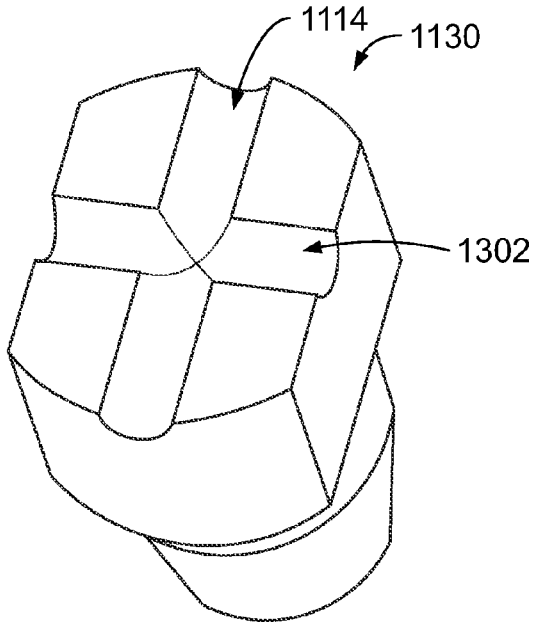

In this example, the sensor assembly 1118 includes first and second portions 1126 and 1128. The first and second portions 1126 and 1128 each include a lens and/or sapphire windows 1130 (FIG. 13) that are secured relative to the flowpath 1114 via retainers 1132. In some examples, the windows 1130 at least partially define the flowpath 1114 and/or a flowpath 1302 through which the wire 1123 extends.

In operation, a fluid sample is introduced into the flowpath 1114 via the third passages 1112 and retained and/or isolated therein via valves (not shown). Current is passed through the wire 1123 to thermally nucleate bubbles in the fluid such that the bubbles can be detected in an optical path 1134 between the windows 1130 using a sensor (not shown). Depending on the behavior of the bubble(s), a determination can be made whether or not the bubble point has been reached. If the pressure is above that of the bubble point pressure based on the behavior of the nucleated bubble(s), a pressure of the fluid sample in the flowpath 1114 may be deceased. This decrease in pressure may be performed incrementally, in steps and/or continuously as bubbles are thermally nucleated in the sample.

Figure 14:
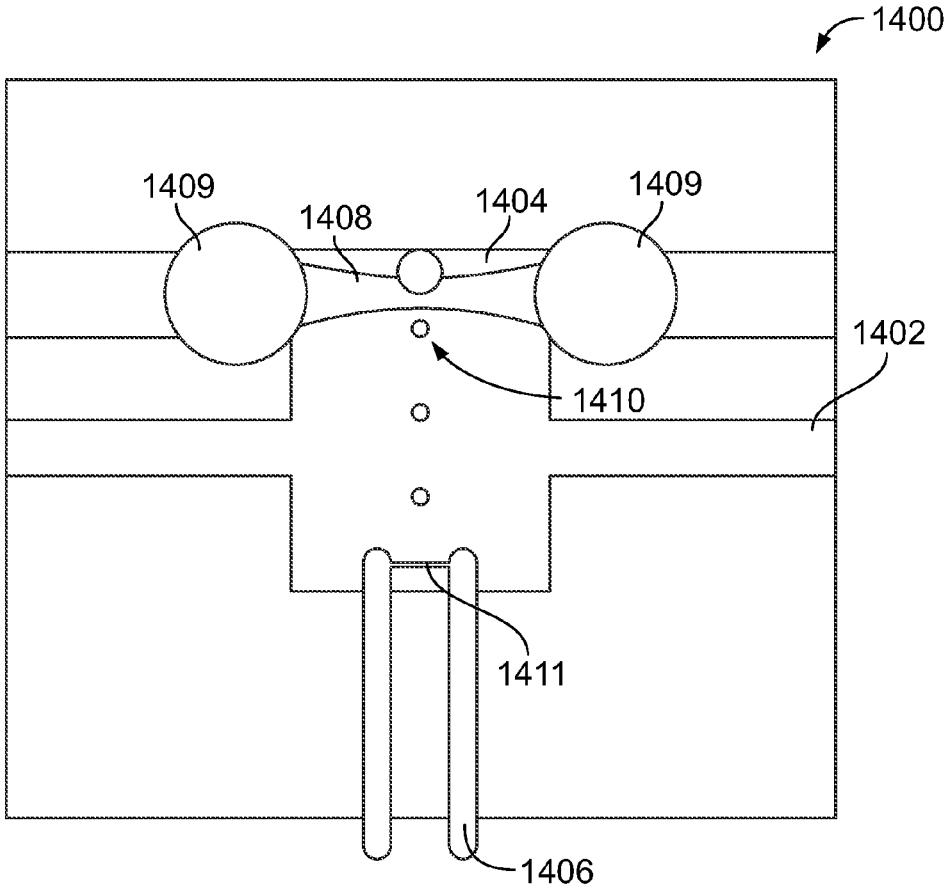
FIG. 14 illustrates various components of an example device that can implement embodiments of the systems and methods of determining parameter values in a downhole environment.

FIG. 14 depicts an example apparatus and/or cell 1400 that can be used to implement the examples disclosed herein. The apparatus 1400 includes a flowpath and/or sample and/or optical 1402, a bubble trap 1404, a heater 1406 and an optical path 1408 through lenses 1409. The lenses 1409 may be ball lenses that can couple light originating from an optical fiber. The geometry of the lenses 1409 may be changed to enable light originating from an optical fiber to be coupled to a component having a dissimilar geometry from that of the optical fiber. In operation, a fluid is isolated within the flowpath 1402 and/or the bubble trap 1404 and the heater 1406 nucleates bubbles 1410 within the fluid by pulsing current through a wire 1411 of the heater 1406. Depending if the bubble point has been reached, the bubbles 1410 are detectable in the optical path 1410 in the bubble trap 1404 using a sensor. Specifically, if the local pressure is lower than the bubble point pressure, the bubble will grow and eventually be detected by the optics. If the local pressure is greater than the bubble point, the bubbles will shrink and disappear after nucleation. The buoyancy of the bubbles 1410 enables the bubbles 1410 to flow into the bubble trap 1404 and be substantially trapped therein outside of the flowpath 1402 for relatively easy detection.

Figure 15:
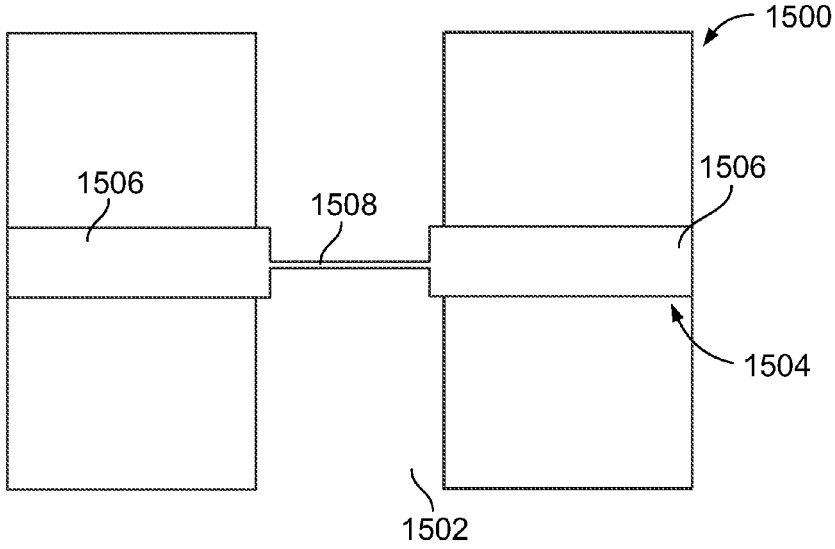
FIG. 15 illustrates various components of an example device that can implement embodiments of the systems and methods of determining parameter values in a downhole environment.

FIG. 15 depicts an example apparatus 1500 that can be used to implement the examples disclosed herein. The apparatus 1500 includes a flowpath and/or sample and/or optical or detection chamber 1502 and a heater assembly 1504 including a plurality of pins 1506 between which a wire 1508 is coupled. The pins 1506 may be connected to feedthroughs (not shown) at lower pressure in the apparatus 1500. In operation, the heater assembly 1504 nucleates bubbles within fluid within the flowpath 1502 by pulsing current through the wire 1508. If the bubble point has been reached, bubbles are detectable using a sensor.

Figure 16:
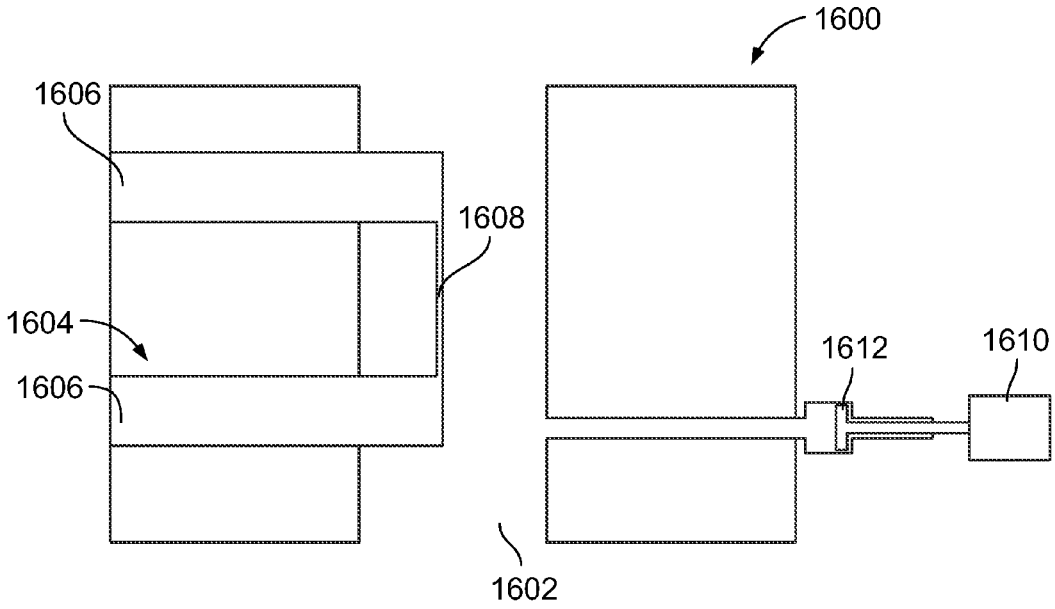
FIG. 16 illustrates various components of an example device that can implement embodiments of the systems and methods of determining parameter values in a downhole environment.

FIG. 16 depicts an example apparatus 1600 that can be used to implement the examples disclosed herein. The apparatus 1600 includes a flowpath and/or sample and/or optical or detection chamber 1602 and a heater assembly 1604 including a plurality of pins 1606 between which a wire 1608 is coupled. The wire 1608 may be positioned substantially parallel to a longitudinal axis of the flowpath 1602. The pins 1606 may be connected to one or more feedthroughs (not shown). Additionally, the example apparatus 1600 may include a pressure controller 1610 to control a pressure of fluid within the flowpath 1602 using a piston 1612. In operation, the heater assembly 1604 nucleates bubbles within fluid within the flowpath 1602 by pulsing current through the wire 1608. If the bubble point has been reached, bubbles are detectable using a sensor. Based on reaching or not reaching the bubble point, the pressure controller 1610 may change (e.g., continuously or incrementally change) the pressure of the fluid. For example, the pressure of the fluid may be decreased as the the heater assembly 1604 nucleates and the sensor senses bubbles within the fluid. If the bubble point is reached, the pressure controller 1610 may repressurize the fluid.

Figure 17:
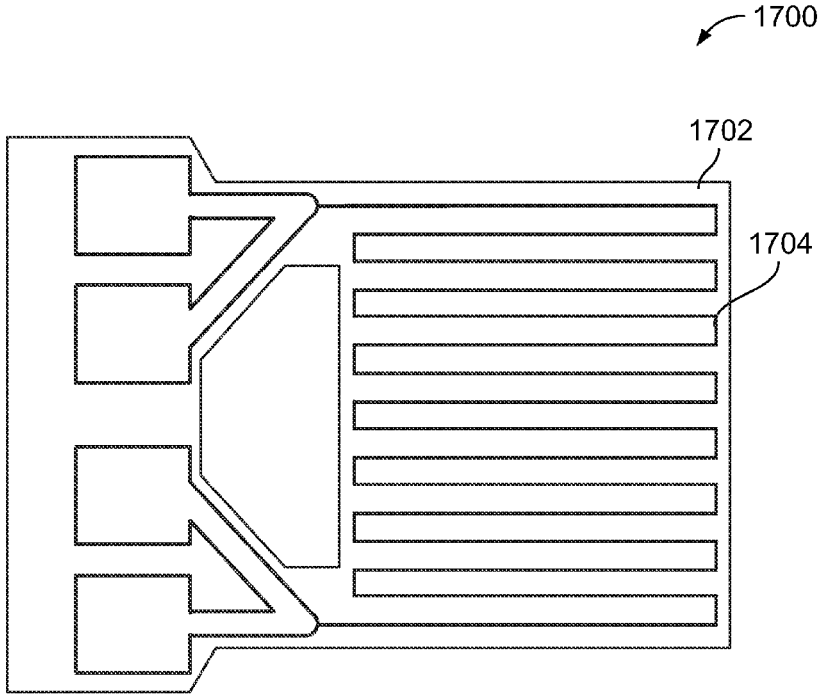
FIG. 17 illustrates a component of an example device that can implement embodiments of the systems and methods of determining parameter values in a downhole environment.

FIG. 17 depicts an example heater 1700 that may be used to implement the examples disclosed herein. The heater 1700 includes a non-conductive substrate 1702 that may be relatively thin and upon which conductive paths and/or metal 1704 may be deposited. The heater 1700 enables a four-probe measurement and/or coupling to be obtained. In operation, the heater 1700 is at least partially positioned in a flowpath and/or fluid and/or optical or detection chamber containing a sample fluid. To nucleate bubbles within the fluid, a current travels through the conductive paths 1704.

Figure 18:
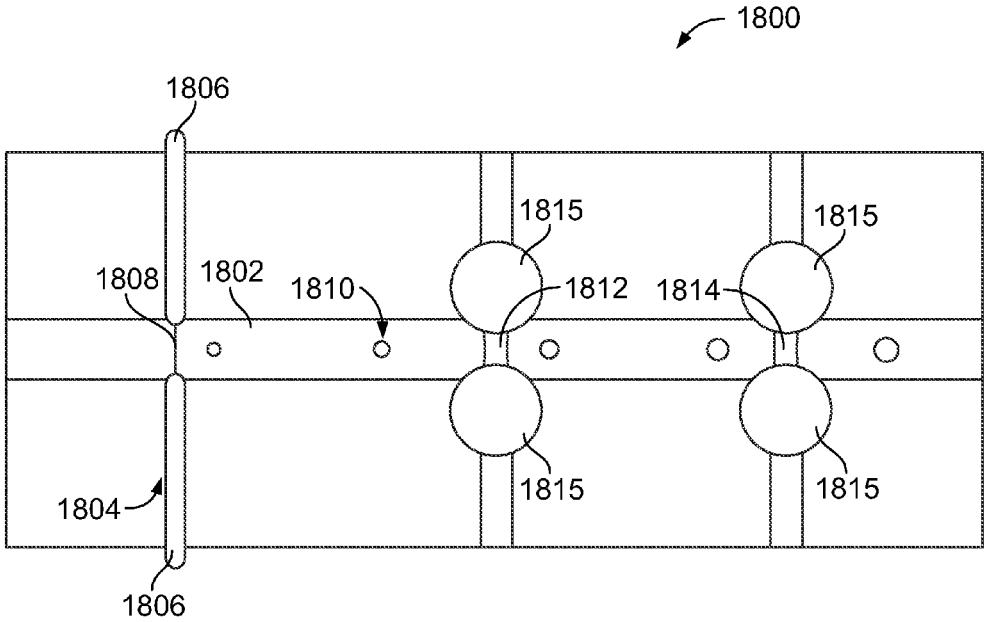
FIG. 18 illustrates various components of an example device that can implement embodiments of the systems and methods of determining parameter values in a downhole environment.

FIG. 18 depicts an example apparatus and/or cell 1800 that can be used to implement the examples disclosed herein. The apparatus 1800 includes a flowpath and/or fluid and/or optical or detection chamber 1802 and a heater assembly 1804 including a plurality of pins 1806 between which a wire 1808 is coupled. The pins 1806 may be connected to one or more feedthroughs (not shown). In operation, the heater assembly 1804 nucleates bubbles 1810 within fluid within the flowpath 1802 by pulsing current through the wire 1808. The bubbles 1810 are convected by the fluid flow past one or more optical windows and/or paths 1812 and 1814 between lenses 1815 where the bubbles 1810 can be detected using one or more sensors. If the bubbles 1810 grow after nucleation and/or as they travel with the fluid flow, then the local pressure is lower than the BP pressure. If the bubbles 1810 shrink and/or are unobservable after nucleation and/or as they travel with the fluid flow, then the local pressure is greater than the BP pressure.

Figure 19:
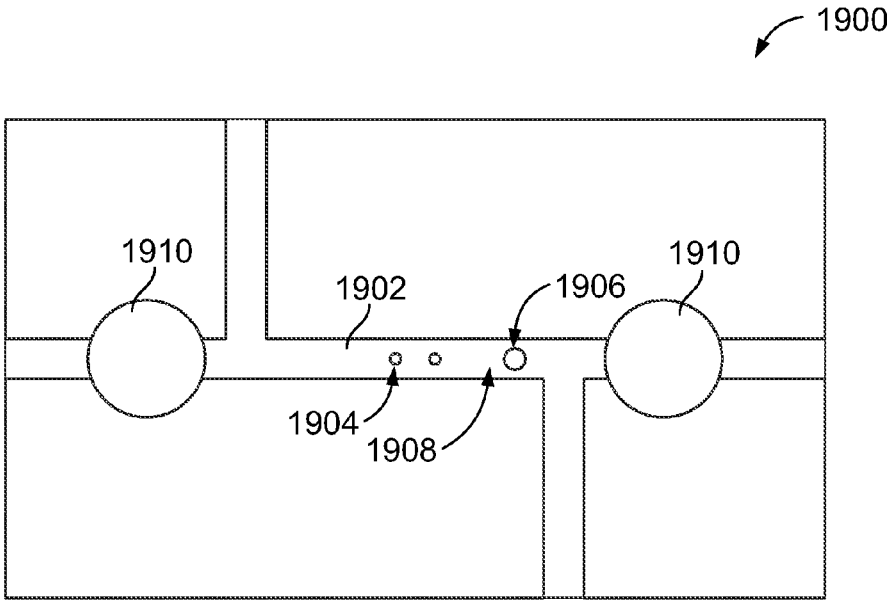
FIG. 19 illustrates various components of an example device that can implement embodiments of the systems and methods of determining parameter values in a downhole environment.

FIG. 19 depicts an example apparatus and/or cell 1900 that can be used to implement the examples disclosed herein. The apparatus 1900 includes a flowpath and/or fluid and/or optical or detection chamber 1902 and a heater assembly 1904. In operation, the heater assembly 1904 nucleates bubbles 1906 within fluid within the flowpath 1902. The bubbles 1906 nucleate and/or flow within an optical path 1908 between lenses 1910 where the behavior of the bubbles 1906 can be observed over time using one or more sensors. In some examples, the optical intensity of the sensors and the electrical pulses of the heater assembly 1904 may be correlated to substantially remove the optical effects from heating.

Figure 20:
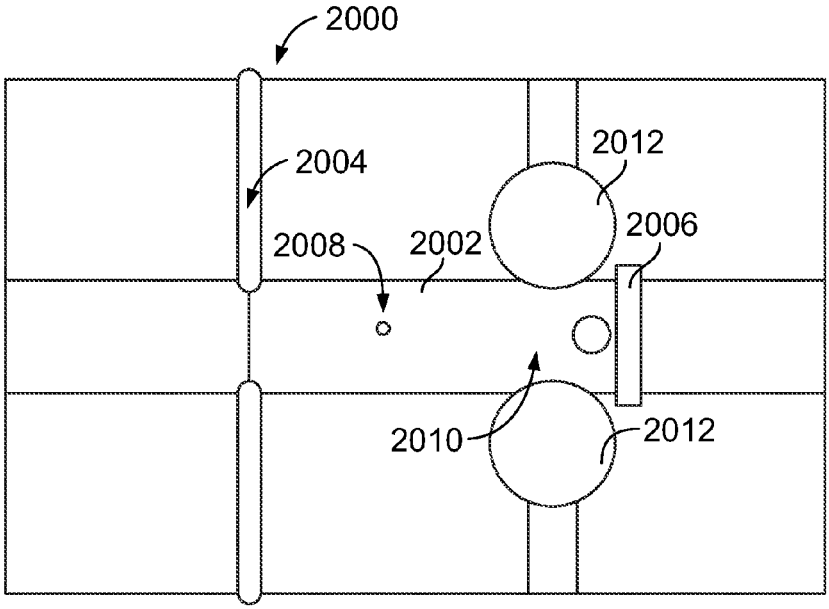
FIG. 20 illustrates various components of an example device that can implement embodiments of the systems and methods of determining parameter values in a downhole environment.

FIG. 20 depicts an example apparatus and/or cell 2000 that can be used to implement the examples disclosed herein. The apparatus 2000 includes a flowpath and/or fluid and/or optical or detection chamber 2002, a heater assembly 2004 and a filter and/or frit 2006. In operation, the heater assembly 2004 nucleates bubbles 2008 within fluid within the flowpath 2002. The bubbles 2008 nucleate and/or flow within an optical path 2010 between lenses 2012 where the behavior of the bubbles 1906 can be observed over time using one or more sensors. Fluid can travel through the frit 2006, but the bubbles 2008 are unable to overcome the surface tension barrier and are trapped and/or unable to pass through the frit 2006, thereby enabling their detection.

Figure 21:
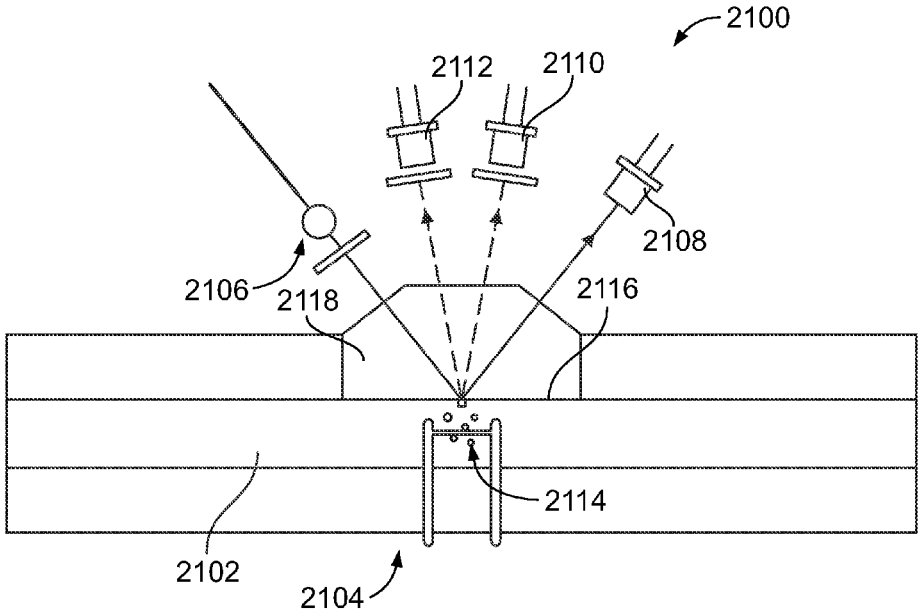
FIG. 21 illustrates various components of an example device that can implement embodiments of the systems and methods of determining parameter values in a downhole environment.

FIG. 21 depicts an example apparatus and/or cell 2100 that can be used to implement the examples disclosed herein. The apparatus 2100 includes a flowpath and/or fluid and/or optical or detection chamber 2102, a heater assembly 2104, a fiber and/or light source 2106 and a plurality of channels (e.g., spectrometer channels), detectors and/or sensors 2108-2112. In operation, the heater assembly 2004 nucleates bubbles 2114 within fluid within the flowpath 2002.

In some examples, the reflection channel 2108 is used to detect the bubbles 2114. A light incident angle to a bottom surface 2116 of a prism 2118 may be set to an angle that is slightly larger than a critical angle to enable the incident light to be reflected in a dry flowline condition. In operation, the bubbles 2114 are created by the heater 2104 and become attached to and/or are adjacent the surface 2116, the incident light reflects to the reflection channel 2108 and a strong signal may be detected because a substantially dry flowline condition may be created at an interface between the bubble 2114 and the prism surface 2116 contact. Fluorescence detection techniques may be used for dew detection. Such a detector may include two fluorescence detection channels that have different cut-off wavelengths of relatively long wavelength pass filters. Fluid characteristic changes in dew precipitation on the surface 2116 may be detected using florescence detection techniques because the spectrum shape of fluorescence light from fluid can be estimated with the signals from these channels. The channels 2110 and 2112 may be used to measure different frequency and/or wavelength ranges.

Figure 22:
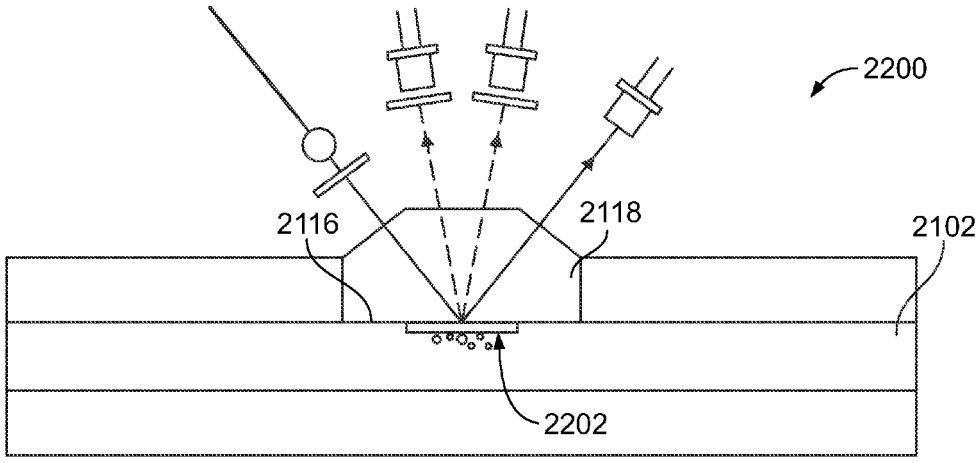
FIGS. 22 and 23 illustrate various components of an example device that can implement embodiments of the systems and methods of determining parameter values in a downhole environment.
Figure 23:
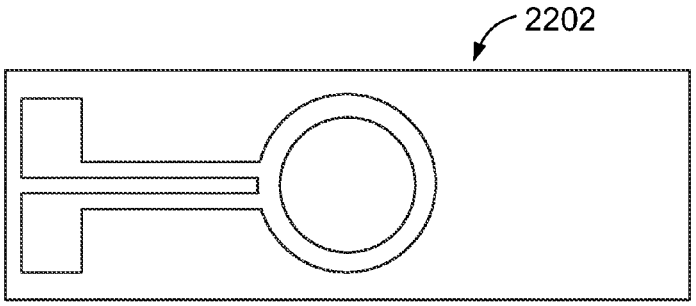

FIG. 22 depicts an example apparatus and/or cell 2200 that can be used to implement the examples disclosed herein. The apparatus 2200 is similar to the apparatus 2100 but includes an alternative example heater assembly 2202 (FIG. 23) that induces bubble nucleation and/or creation using metal resistance deposited on the surface 2116 of the prism 2118.

Figure 24:
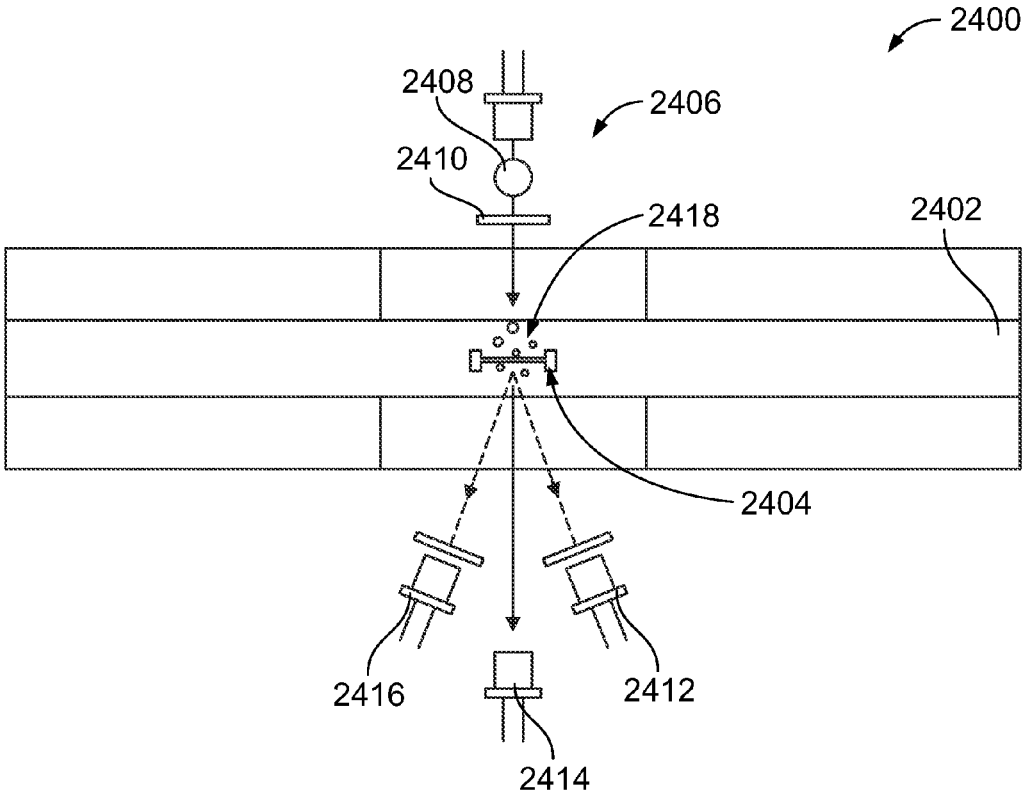
FIG. 24 illustrates various components of an example device that can implement embodiments of the systems and methods of determining parameter values in a downhole environment.

FIG. 24 depicts an example apparatus and/or cell 2400 that can be used to implement the examples disclosed herein. The apparatus 2400 includes a flowpath and/or fluid and/or optical or detection chamber 2402, a heater assembly 2404, a fiber and/or light source 2406, a lens 2408, a filter 2410 and a plurality of channels (e.g., spectrometer channels), detectors and/or sensors 2412-2416. In operation, the heater assembly 2404 nucleates bubbles 2418 within fluid within the flowpath 2402. The bubbles 2418 may be detected by signal intensity changes in the scattering channel 2414 and dew precipitation may be detected as described above.

Figure 25:
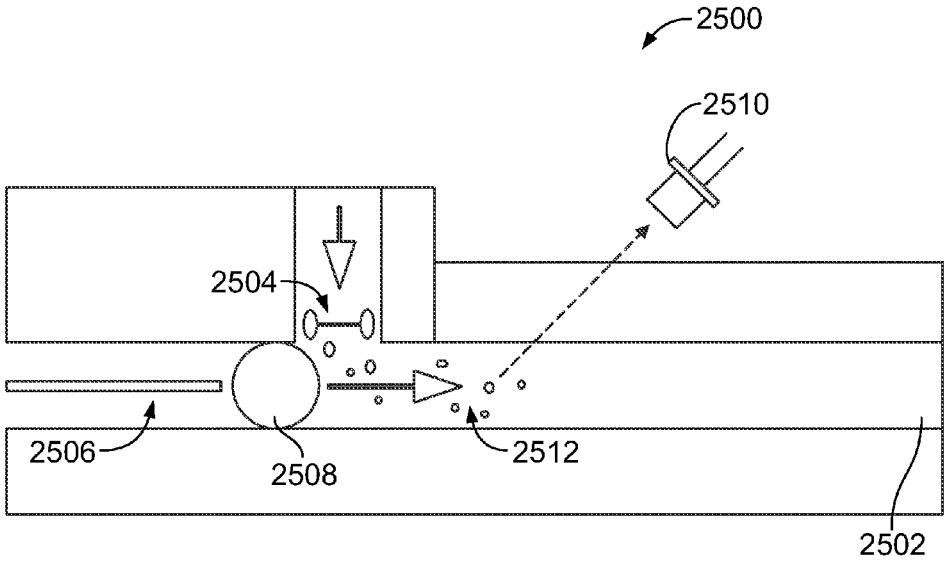
FIG. 25 illustrates various components of an example device that can implement embodiments of the systems and methods of determining parameter values in a downhole environment.

FIG. 25 depicts an example apparatus and/or cell 2500 that can be used to implement the examples disclosed herein. The apparatus 2500 includes a flowpath and/or fluid and/or optical or detection chamber 2502, a heater assembly 2504, a fiber and/or light source 2506, a lens 2508, and a channel, detector and/or sensor 2510. In operation, the heater assembly 2504 nucleates bubbles 2512 within fluid within the flowpath 2502. The bubbles 2512 may be detected by a signal intensity changes in the scattering detector 2510. The scattering detector 2510 may be used to evaluate asphaltene particle and/or bubble size. The size may be identified from the scattering light intensity with a scattering angle because the scattering intensity may be dominated by the size of the particle and/or bubble, refractive index of the particle and surrounding fluid and the wavelength of the light source. The particle and/or bubble(s) 2512 may be created and/or nucleated using the heater 2504 adjacent the lens 2508. The bubble(s) 2512 may be conveyed by the fluid flow to an area where the bubble may be illuminated using the light source 2506.

Figure 26:
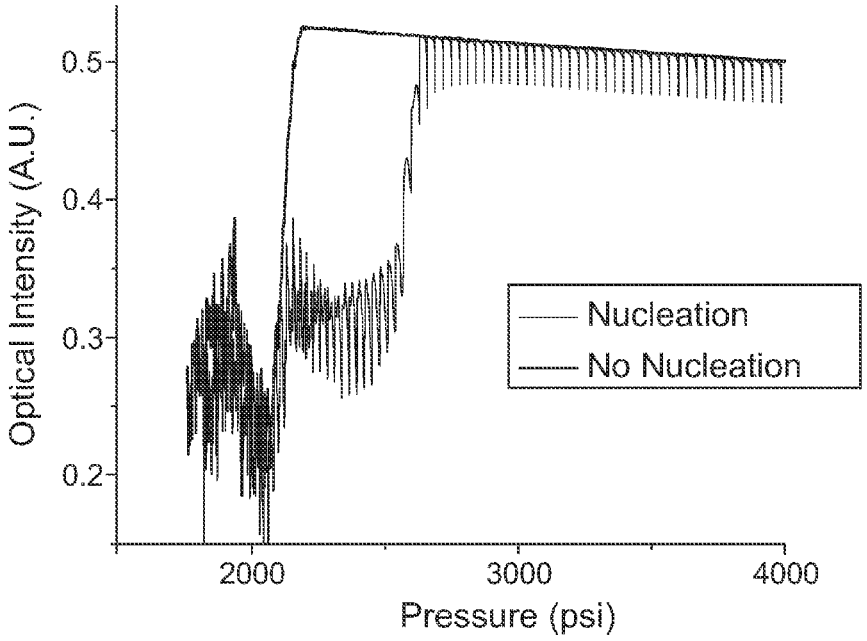
FIGS. 26-29 depict example graphs associated with the examples disclosed herein.

FIGS. 26-29 depict graphs associated with the examples disclosed herein. Referring to FIG. 26, during the depressurization stage, the optical transmission through the nucleation cell is monitored. In this example, the optical transmission through the cell is characterized by the optical intensity of light directed through the cell. The y-axis of FIGS. 26-29 is associated with optical intensity. The bubble point is easily detectable when the optical transmission through the fluid sample decreases substantially. In some examples, when thermal nucleation is applied, the optical transmission decreases suddenly at approximately 3940 psi. This pressure was verified to be the thermodynamic bubble point by measurements in a conventional view cell. However, when thermal nucleation is not applied, the optical transmission decreases suddenly at approximately 3800 psi, an error of 140 psi. Thermal nucleation enables the nucleation barrier to be overcome and, thus, for bubbles to be produced. The quantity of bubbles produced at the thermodynamic bubble point via thermal nucleation is sufficiently small that their effects may only be detectable in the nucleation cell. However, if the system is further depressurized, thereby causing the system to be supersaturated, bubble nucleation may spontaneously occur throughout the measurement system.

Figure 27:
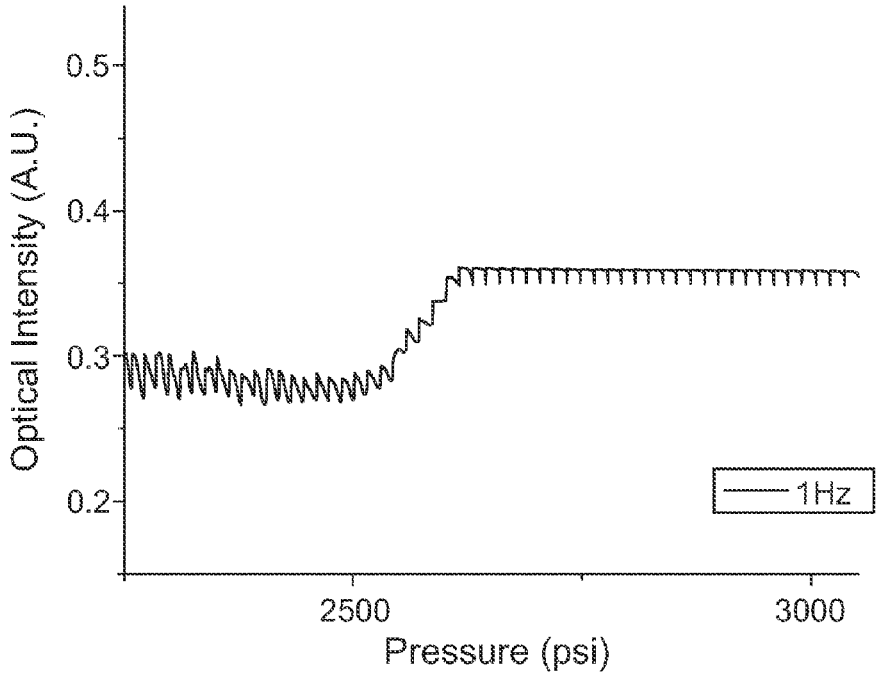
Figure 28:
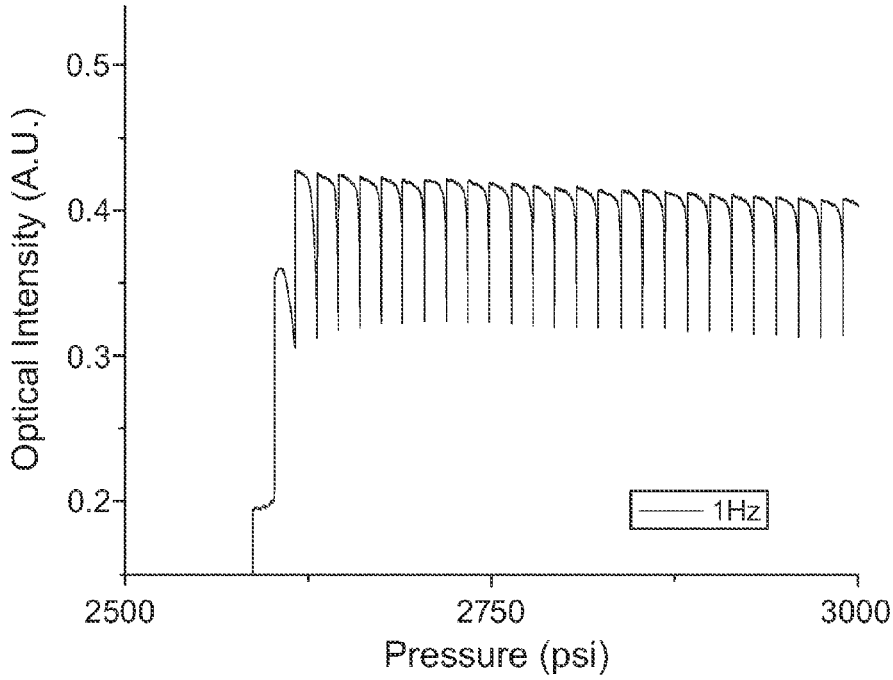
Figure 29:
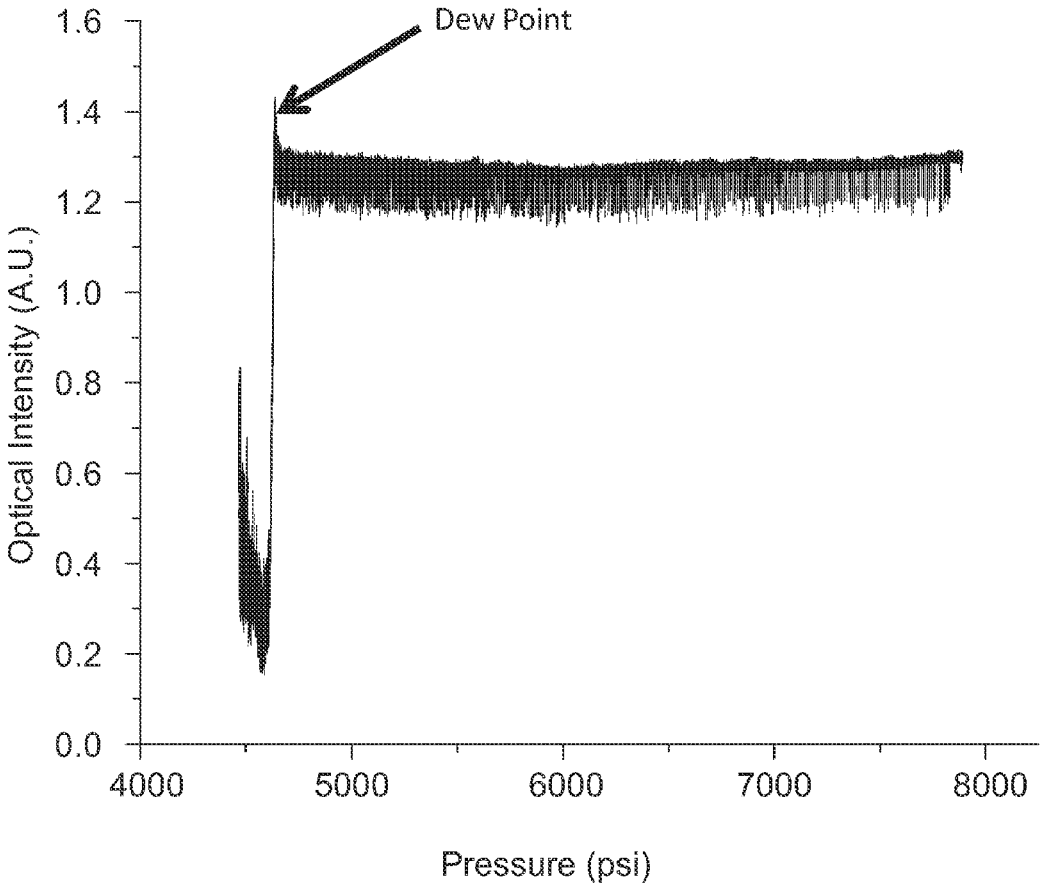

Referring to FIGS. 27 and 28, the examples disclosed herein may monitor and/or observe optical transmission recovery to differentiate between nucleation at pressures above the bubble point and the production of stable bubbles at or below the bubble point. An indication that the fluid sample is above the bubble point is associated with a sharp optical transmission decrease followed by a relatively fast optical transmission recovery indicative of bubble creation and dissolution. A sharp optical transmission decrease with no recovery may be associated with the bubble point, indicative of stable bubble formation. FIG. 29 depicts a graph of dew detection using a microfluidic optical scattering technique with and without thermal nucleation.

Figure 30:
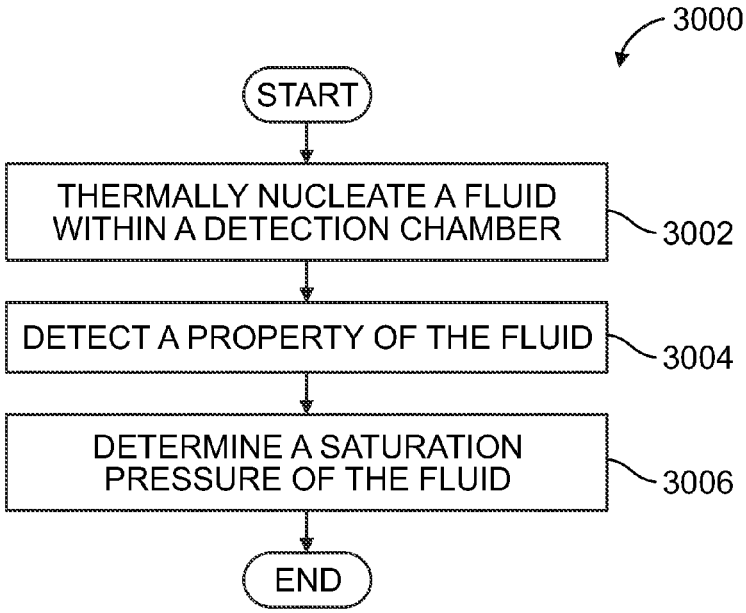
FIG. 30 is an example method of implementing the examples disclosed herein.

A flowchart representative of an example method 3000 for implementing the examples disclosed herein is shown in FIG. 30. In this example, the method 3000 comprises a program for execution by a processor such as the processor P105 shown in the example computer P100 discussed below in connection with FIG. 31. The program may be embodied in software stored on a tangible computer readable medium such as a CD-ROM, a floppy disk, a hard drive, a digital versatile disk (DVD), a BluRay disk, or a memory associated with the processor P100, but the entire program and/or parts thereof could alternatively be executed by a device other than the processor P100 and/or embodied in firmware or dedicated hardware. Further, although the example program is described with reference to the flowchart illustrated in FIG. 30, many other methods of implementing the example the examples disclosed herein may alternatively be used. For example, the order of execution of the blocks may be changed, and/or some of the blocks described may be changed, eliminated, or combined.

As mentioned above, the example operations of FIG. 30 may be implemented using coded instructions (e.g., computer readable instructions) stored on a tangible computer readable medium such as a hard disk drive, a flash memory, a read-only memory (ROM), a compact disk (CD), a digital versatile disk (DVD), a cache, a random-access memory (RAM) and/or any other storage media in which information is stored for any duration (e.g., for extended time periods, permanently, brief instances, for temporarily buffering, and/or for caching of the information). As used herein, the term tangible computer readable medium is expressly defined to include any type of computer readable storage and to exclude propagating signals.

Referring to FIG. 30, the heater assembly 412, 714, 1116, 1504, 1604, 1804, 1904, 2004, 2204, 2404 and/or 2504 that is partially positioned within the detection chamber 410, 712, 1502, 1602, 1802, 1902, 2002, 2102, 2402 and/or 2502 may thermally nucleate a fluid within the detection chamber 410, 712, 1502, 1602, 1802, 1902, 2002, 2102, 2402 and/or 2502. (block 3002). After nucleation, the sensor assembly 414, 716 and/or 1118 may detect a property of the fluid. (block 3004). The property may be an optical measurement, an acoustic contrast measurement and/or a thermal conductivity measurement. The processor P100 may then determine a saturation pressure of the fluid using the property. (block 3006). The saturation pressure may be a bubble point or a dew point of the fluid. In some examples, the processes of blocks 3002-3006 may be performed in a first wellbore region and then performed in a second wellbore region different than the first wellbore region.

Figure 31:
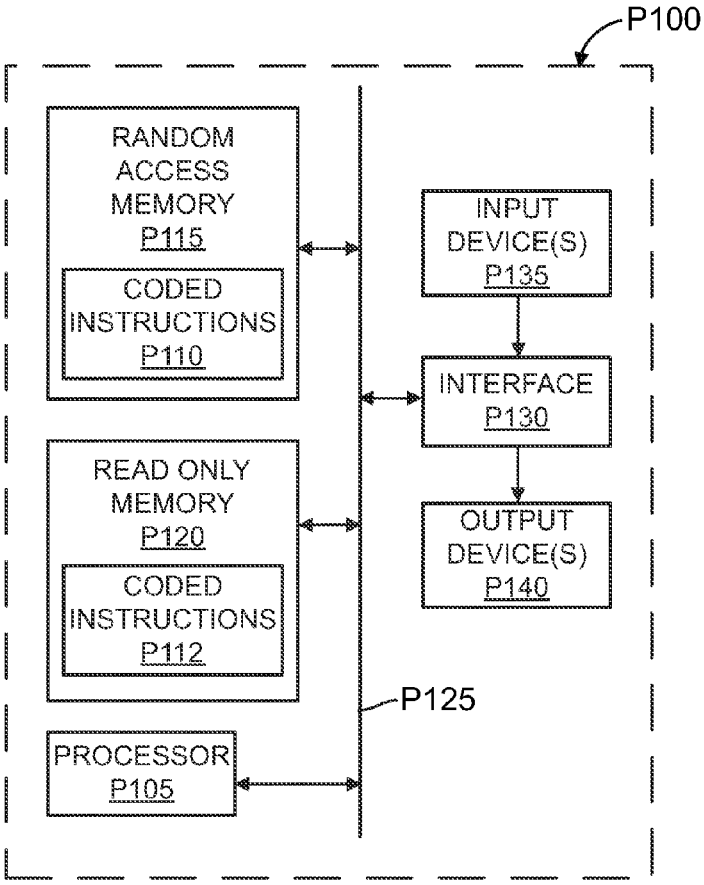
FIG. 31 is a schematic illustration of an example processor platform that may be used and/or programmed to implement any or all of the example systems and methods described herein.

FIG. 31 is a schematic diagram of an example processor platform P100 that may be used and/or programmed to implement to implement the electronics and processing system 156 and/or any of the examples described herein. For example, the processor platform P100 can be implemented by one or more general purpose processors, processor cores, microcontrollers, etc.

The processor platform P100 of the example of FIG. 31 includes at least one general purpose programmable processor P105. The processor P105 executes coded instructions P110 and/or P112 present in main memory of the processor P105 (e.g., within a RAM P115 and/or a ROM P120). The processor P105 may be any type of processing unit, such as a processor core, a processor and/or a microcontroller. The processor P105 may execute, among other things, the example methods and apparatus described herein.

The processor P105 is in communication with the main memory (including a ROM P120 and/or the RAM P115) via a bus P125. The RAM P115 may be implemented by dynamic random-access memory (DRAM), synchronous dynamic random-access memory (SDRAM), and/or any other type of RAM device, and ROM may be implemented by flash memory and/or any other desired type of memory device. Access to the memory P115 and the memory P120 may be controlled by a memory controller (not shown).

The processor platform P100 also includes an interface circuit P130. The interface circuit P130 may be implemented by any type of interface standard, such as an external memory interface, serial port, general purpose input/output, etc. One or more input devices P135 and one or more output devices P140 are connected to the interface circuit P130.

The examples disclosed herein may relate to non-mechanical means of overcoming a nucleation barrier to enable accurate saturation pressure measurements. In some examples, the examples may be implemented in a high pressure high temperature cell having a microliter scale volume that enables optical interrogation to determine the phase of the fluid sample (e.g., a single-phase, a two-phase). The optical interrogation may be performed using a single channel photodiode or a broad-band light source. The light source may not use direct imaging. The cell may include a plurality of spectrometer channels and/or a fluorescence detector used to test for asphaltene flocculation.

In some examples, the examples may be implemented in a high pressure high temperature cell having a microliter scale volume that enables acoustic interrogation, thermal conductivity interrogation and/or dielectric interrogation to determine the phase of the fluid sample (e.g., a single-phase, a two-phase). Such a cell may be fabricated without silicon-based micromachining techniques.

In some examples, the high pressure high temperature cell may enable fluid exchange or flushing. In some examples, the example apparatus and/or cell may distinguish between bubble creation and/or dew (e.g., liquid) creation when the saturation pressure is reached and the fluid and/or system is in a two-phase region of the phase diagram. Optical techniques, acoustic techniques, density measurements, viscosity measurements and/or thermal conductivity techniques may be used to distinguish between bubbles and/or dew. In some examples, the example apparatus and/or cell may enable the determination of the AOP and/or a nucleation barrier vs. temperature measurement to determine if the system is near the critical point.

A saturation pressure of a formation fluid may be determined at temperatures other than the reservoir formation or temperatures proximate thereto. In some examples, a formation sample may be obtained from a first zone at a first temperature where measurements may be conducted on at least a portion of the sample and then the sample may moved to a second zone at a second temperature where measurements may be conducted on at least a portion of the sample. Generally, temperature increases when lowering the tool deeper into the borehole and the temperature decreases when raising the tool toward the surface.

In operation, after a formation sample has been obtained, the tool may be positioned in a different wellbore region, the formation sample may be allowed to equilibrate with the temperature of that wellbore region and measurements may be taken. In some examples, the measurements may enable a saturation pressure of the sample to be determined at one or more temperatures other than the formation temperature. A plurality of saturation pressures may enable a phase envelope (equation of state) to be refined using at least two bubble/dewpoint pressure measurements, density, viscosity, composition, etc.

Although a few example embodiments have been described in detail above, those skilled in the art will readily appreciate that many modifications are possible in the example embodiments without materially departing from this invention. Accordingly, such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

What is claimed is:

1. An apparatus to determine a saturation pressure of a fluid, comprising:

a housing having a detection chamber;

a heater assembly partially positioned within the detection chamber controlled by an electronics and processing system configured to temporarily heat only a local portion of a fluid resulting in thermal nucleation and then the fluid returning to an ambient temperature and comprising;

current transporting conductors; and a wire within the detection chamber and electrically coupled to the current transporting conductors that temporarily heats the local portion of the fluid;

wherein a cross-sectional area of the current transporting conductors is larger than a cross-sectional area of the wire;

a sensor assembly to detect a property of the fluid;

a pressure controller to control a pressure of the fluid; and wherein the electronics and processing system identifies a saturation pressure of the fluid using the property of the fluid, and wherein the heater assembly is to temporarily heat the local portion of the fluid without increasing a temperature of the detection chamber by more than approximately 0.1° C.

2. The apparatus of claim 1, wherein the property is associated with one or more of an optical measurement, an acoustic contrast measurement, or a thermal conductivity measurement.

3. The apparatus of claim 1, wherein the detection chamber comprises an optical chamber.

4. The apparatus of claim 1, wherein the saturation pressure comprises at least one of a bubble point pressure or a dew point pressure.

5. The apparatus of claim 1, wherein an optical path extends through the detection chamber and at least a portion of the heater assembly is positioned within the optical path.

6. The apparatus of claim 1, wherein the wire is to extend across or along a flowpath that is to receive the fluid.

7. The apparatus of claim 6, wherein the heater assembly is to at least partially define the flowpath.

8. The apparatus of claim 1, further comprising one or more lenses or windows to enable the sensor assembly to identify the property of the fluid.

9. The apparatus of claim 8, wherein one or more of the lenses defines a flowpath that is to receive the fluid.

10. The apparatus of claim 8, wherein one or more of the lenses defines a groove in which a portion of the heater assembly is positioned.

11. The apparatus of claim 1, wherein the sensor assembly comprises one or more of an optical sensor, a spectrometer, an optical fiber, a fluorescence detection channel, a spectrometer channel, or a sensor.

12. The apparatus of claim 1, wherein the housing defines a plurality of apertures to receive at least a portion of one or more of the heater assembly or the sensor assembly.

13. The apparatus of claim 1, wherein the pressure controller comprises a piston.

14. The apparatus of claim 13, wherein the piston is to provide a controlled pressure change.

15. A method of determining a saturation pressure of a fluid, comprising:

A) temporarily thermally nucleating only a localized portion of the fluid within a detection chamber, and allowing the fluid to return to ambient temperature;

B) detecting a property of the fluid; and

C) determining a saturation pressure of the fluid using the property.

16. The method of claim 15, further comprising performing processes A, B and C in a first wellbore region and performing processes A, B and C in a second wellbore region.

17. A downhole tool, comprising:

a microfluidic device, comprising:

a detection chamber;

a heater assembly at least partially positioned within the detection chamber controlled by an electronics and processing system configured to temporarily heat only a local portion of a fluid resulting in thermal nucleation, wherein the heater assembly only heats the local portion of the fluid without increasing a temperature of the detection chamber by more than approximately 0.1° C., the heater assembly comprising;

current transporting conductors; and a wire within the detection chamber electrically coupled to the current transporting conductors that temporarily heats the local portion of the fluid;

wherein a cross-sectional area of the current transporting conductors is larger than a cross-sectional area of the wire; and a sensor assembly to detect a property of the fluid; and wherein the electronics and processing system determines a parameter of the downhole fluid using the property of the fluid.

18. The apparatus of claim 1, wherein the heater assembly generates heat pulses, each pulse having shorter duration of heat than duration of no heat.

19. The method of claim 15, wherein thermally nucleating a fluid within a detection chamber comprises:

supplying heat pulses, each pulse having shorter duration of heat than duration of no heat.

20. The method of claim 19, wherein the duration of heat is between 100 ns and 100 ms.

21. The method of claim 19, wherein the heat pulse has a frequency at least 1 Hz or higher.

22. The method of claim 19, wherein the temperature increase of the detection chamber caused by the heat pulses is no more than 0.1° C.

23. The apparatus of claim 1, wherein the detection chamber is located proximate to a bubble trap.

* * * * *